US007556901B2

(12) United States Patent
Anezaki et al.

(10) Patent No.: US 7,556,901 B2
(45) Date of Patent: Jul. 7, 2009

(54) ELECTROPHOTOGRAPHIC PHOTOSENSITIVE MEMBER, PROCESS CARTRIDGE, AND ELECTROPHOTOGRAPHIC APPARATUS

(75) Inventors: Takashi Anezaki, Hiratsuka (JP); Harunobu Ogaki, Suntoh-gun (JP); Hiroki Uematsu, Suntoh-gun (JP); Masataka Kawahara, Mishima (JP); Atsushi Ochi, Numazu (JP); Kyoichi Teramoto, Abiko (JP); Akira Shimada, Suntoh-gun (JP); Akio Maruyama, Tokyo (JP); Toshihiro Kikuchi, Yokohama (JP); Akio Koganei, Ichikawa (JP); Takayuki Sumida, Kawasaki (JP); Hirotoshi Uesugi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/770,270

(22) Filed: Jun. 28, 2007

(65) Prior Publication Data

US 2008/0124126 A1 May 29, 2008

Related U.S. Application Data

(63) Continuation of application No. PCT/JP2007/051860, filed on Jan. 30, 2007.

(30) Foreign Application Priority Data

| | | |
|---|---|---|
| Jan. 31, 2006 | (JP) | 2006-022896 |
| Jan. 31, 2006 | (JP) | 2006-022898 |
| Jan. 31, 2006 | (JP) | 2006-022899 |
| Jan. 31, 2006 | (JP) | 2006-022900 |
| Jan. 26, 2007 | (JP) | 2007-016221 |

(51) Int. Cl.
*G03G 5/04* (2006.01)

(52) U.S. Cl. ..... 430/56; 430/66; 399/116; 399/159

(58) Field of Classification Search ..... 430/66, 430/67, 58.05, 56; 399/116, 159
See application file for complete search history.

(56) References Cited

U.S. PATENT DOCUMENTS 4,985,330 A 1/1991 Tsuchiya et al.

(Continued)

FOREIGN PATENT DOCUMENTS

JP 52026226 2/1977

(Continued)

OTHER PUBLICATIONS

PCT Notification Concerning Transmittal of Copy of International Preliminary Report on Patentability (Chapter 1 of the Patent Cooperation Treaty) (Form PCT/IB/326); International Preliminary Report on Patentability (Chapter 1 of the Patent Cooperation Treaty) (Form PCT/IB/373); Written Opinion of The International Searching Authority (Form PCT/ISA/237), regarding Internation Application No. PCT/JP2006/313351; PCT Notofication of Transmittal of Copies of Translation of the International Prelimary Report on Patentability (Chapter I or Chapter II of the Patent Cooperation Treaty) (Form PCT/IB/338).

*Primary Examiner*—Janis L Dote
(74) *Attorney, Agent, or Firm*—Fitzpatrick, Cella, Harper & Scinto

(57) ABSTRACT

An electrophotographic photosensitive member has a surface having a plurality of depressed portions, having a major-axis diameter Rpc of 0.1 to 10 μm, a minor-axis diameter Lpc of 0.1 to 10 μm and a deepest-part to opening distance Rdv of 0.1 to 10 μm. Where the surface is equally divided into 4 regions in the rotational direction, which are then equally divided into 25 regions in the direction falling at right angles with the rotational direction, to obtain 100-spot regions A in total, and, in each thereof, square regions B of 50 μm each per side one side of which is parallel to the rotational direction are provided and the regions B are each equally divided into 500 zones by straight lines parallel to the rotational direction, 400 to 499 lines among the straight lines pass through the depressed portions in each of the regions B.

9 Claims, 18 Drawing Sheets

U.S. PATENT DOCUMENTS

| | | | | |
|---|---|---|---|---|
| 5,114,814 | A | 5/1992 | Sakoh et al. | |
| 5,242,773 | A | 9/1993 | Iino et al. | |
| 5,242,776 | A | 9/1993 | Doi et al. | 430/67 |
| 5,411,827 | A | 5/1995 | Tamura et al. | |
| 5,427,880 | A | 6/1995 | Tamura et al. | |
| 5,496,671 | A | 3/1996 | Tamura et al. | |
| 6,180,303 | B1 | 1/2001 | Uematsu et al. | |
| 7,186,489 | B2 | 3/2007 | Uematsu et al. | |
| 7,226,711 | B2 | 6/2007 | Amamiya et al. | |
| 2005/0255393 | A1 | 11/2005 | Nakata et al. | |
| 2007/0254232 | A1 | 11/2007 | Kawahara et al. | |
| 2008/0019735 | A1 | 1/2008 | Ogaki et al. | |

FOREIGN PATENT DOCUMENTS

| | | | |
|---|---|---|---|
| JP | 53092133 | | 8/1978 |
| JP | 57094772 | | 6/1982 |
| JP | 2127652 | | 5/1990 |
| JP | 2139566 | | 5/1990 |
| JP | 2150850 | | 6/1990 |
| JP | 04-175759 | | 6/1992 |
| JP | 04-175767 | | 6/1992 |
| JP | 5216249 | | 8/1993 |
| JP | 7072640 | | 3/1995 |
| JP | 10039521 | | 2/1998 |
| JP | 2000066424 | | 3/2000 |
| JP | 2000066425 | | 3/2000 |
| JP | 2001066814 | | 3/2001 |
| JP | 2006-011047 | | 1/2006 |
| WO | 2005093518 | A1 | 6/2005 |

ELECTROPHOTOGRAPHIC PHOTOSENSITIVE MEMBER, PROCESS CARTRIDGE, AND ELECTROPHOTOGRAPHIC APPARATUS

This application is a continuation of International Application No. PCT/JP2007/051860, filed on Jan. 30, 2007, which claims the benefit of Japanese Patent Application Nos. 2006-022896, filed on Jan. 31, 2006, 2006-022898, filed on Jan. 31, 2007, 2006-022899, filed on Jan. 31, 2007, 2006-022900, filed on Jan. 31, 2006 and 2007-016221, filed on Jan. 26, 2007.

BACKGROUND OF THE INVENTION

1. Field of the Invention

This invention relates to an electrophotographic photosensitive member, and a process cartridge and an electrophotographic apparatus which have the electrophotographic photosensitive member.

2. Description of the Related Art

As an electrophotographic photosensitive member (hereinafter also simply "photosensitive member"), in view of advantages of low prices and high productivity, an organic electrophotographic photosensitive member has become popular, which has a support and provided thereon a photosensitive layer (organic photosensitive layer) making use of organic materials as photoconductive materials (such as a charge generating material and a charge transporting material). As the organic electrophotographic photosensitive member, one having what is called a multi-layer type photosensitive layer is prevalent, which is a photosensitive layer constituted of a charge generation layer containing a charge generating material such as a photoconductive dye or a photoconductive pigment and a charge transport layer containing a charge transporting material such as a photoconductive polymer or a photoconductive low-molecular weight compound; the layers being superposed to form the photosensitive layer. This is one taking account of advantages such as a high sensitivity and a variety for material designing.

Electrophotographic photosensitive members are commonly used in electrophotographic image forming processes together with developing materials. Electrical external force and mechanical external force are directly applied to the surfaces of the electrophotographic photosensitive members, and hence many problems may arise.

As a problem of such electrophotographic photosensitive members, image deterioration may be given which is caused by scratches made on the electrophotographic photosensitive member surfaces because of the above external force. To solve such a problem, it is actively studied to improve electrophotographic photosensitive member surface layers. Stated specifically, it is attempted to improve the mechanical strength of surface layers in order to improve the durability of photosensitive member surfaces against their scratch and wear that come about because of such external force.

Polycarbonate resin has hitherto widely been used as a binder resin for surface layers of electrophotographic photosensitive members. In recent years, it is proposed that polyarylate resin, which has a higher mechanical strength than the polycarbonate resin, is used so that the surface layers can be improved in mechanical strength (see, e.g., Japanese Patent Application Laid-open No. H10-039521). The polyarylate resin is one of aromatic dicarboxylic acid polyester resins.

Japanese Patent Application Laid-open No. H02-127652 discloses an electrophotographic photosensitive member having as a surface layer a cured layer making use of a curable resin as a binder resin. Japanese Patent Applications Laid-open No. H05-216249 and No. H07-072640 also disclose an electrophotographic photosensitive member having as a surface layer a charge transporting cured layer formed by subjecting monomers to cure polymerization in the presence of energy of heat or light; the monomers being a binder resin monomer having a carbon-carbon double bond and a monomer having a charge transporting function and having a carbon-carbon double bond. Japanese Patent Applications Laid-open No. 2000-066424 and No. 2000-066425 further disclose an electrophotographic photosensitive member having as a surface layer a charge transporting cured layer formed by subjecting a compound to cure polymerization in the presence of energy of electron rays; the compound being a hole transporting compound having a chain-polymerizable functional group in the same molecule.

Thus, in recent years, as techniques by which the mechanical strength of the surfaces of electrophotographic photosensitive members are improved, techniques have been proposed in which a binder resin having a high mechanical strength is used in the surface layers of electrophotographic photosensitive members and in which surface layers are formed as cured layers.

In recent years, a method is also proposed in which the surface of the electrophotographic photosensitive member is appropriately roughened for the purpose of improving the performance in cleaning the photosensitive member surface by means of a cleaning member.

As a method of roughening the surface of the electrophotographic photosensitive member, Japanese Patent Application Laid-open No. S53-092133 discloses a technique in which the surface roughness (roughness of peripheral surface) of the electrophotographic photosensitive member is controlled within a specific range in order to make transfer materials readily separable from the surface of the electrophotographic photosensitive member. This Japanese Patent Application Laid-open No. S53-092133 also discloses a method in which drying conditions in forming a surface layer is controlled to roughen the surface of the electrophotographic photosensitive member in orange peel. Japanese Patent Application Laid-open No. S52-026226 discloses a technique in which the surface layer is incorporated with particles to roughen the surface of the electrophotographic photosensitive member. Japanese Patent Application Laid-open No. S57-094772 discloses a technique in which the surface of a surface layer is sanded with a wire brush made of a metal to roughen the surface of the electrophotographic photosensitive member. Japanese Patent Application Laid-open No. H01-099060 discloses a technique in which specific cleaning device and toner are used to roughen the surface of an organic electrophotographic photosensitive member. According to this Japanese Patent Application Laid-open No. H01-099060, it is described that the problems of turn-up of the cleaning blade and chipping of edges thereof can be solved which may come into question when used in an electrophotographic apparatus having a certain higher process speed.

Japanese Patent Application Laid-open No. H02-139566 discloses a technique in which the surface of a surface layer is sanded with a filmy abrasive to roughen the surface of the electrophotographic photosensitive member. Japanese Patent Application Laid-open No. H02-150850 discloses a technique in which blasting is carried out to roughen the surface of the electrophotographic photosensitive member. This technique, however, is unclear as to details of a surface profile of the electrophotographic photosensitive member surfaceroughed by such a method. International Publication No. 2005/93518 pamphlet discloses a technique in which the above blasting is carried out to roughen the peripheral surface of the electrophotographic photosensitive member, and discloses an electrophotographic photosensitive member having a stated dimple profile. It is described therein that improvements have been achieved in regard to smeared images tending to come about in a high-temperature and high-humidity environment and transfer performance of toner. Japanese Patent Application Laid-open No. 2001-066814 also discloses a technique in which the surface of the electrophotographic photosensitive member is processed by compression forming by means of a stamper having unevenness in the form of wells.

SUMMARY OF THE INVENTION

In the methods of improving the mechanical strength of the surface layers of electrophotographic photosensitive member as disclosed in the above Japanese Patent Applications Laid-open No. H10-039521, No. H02-127652, No. H05-216249, No. H07-72640, No. 2000-66424 and No. 2000-66425, enhancing the strength of the resin has brought achievement in keeping the surface from coming scratched. However, these methods can not be said to be sufficient for keeping scratches from growing, in order to provide high-quality images over a long period of time.

In the proposals disclosed in the above Japanese Patent Applications Laid-open No. S53-92133, No. S52-26226, No. S57-94772, No. H01-99060, No. H02-139566 and No. H02-150850 and International Publication No. 2005/93518 pamphlet, the processing of electrophotographic photosensitive member surfaces has achieved an improvement in cleaning performance. However, these proposals can not be said to be sufficient for keeping scratches from growing which have come about on the electrophotographic photosensitive member surfaces.

In the electrophotographic photosensitive member disclosed in the above Japanese Patent Application Laid-open No. 2001-066814, providing the photosensitive member surface with fine unevenness has achieved an improvement in transfer performance of toner. This, however, can not be said to be sufficient in order to keep scratches from growing which have come about on the electrophotographic photosensitive member surfaces.

A subject of the present invention is to keep the electrophotographic photosensitive member surface from coming scratched in a size causative of faulty images and keep scratches from growing, to thereby provide an electrophotographic photosensitive member which can form good images over a long period of time, and a process cartridge and an electrophotographic apparatus which have the electrophotographic photosensitive member.

As a result of extensive studies made on scratches coming about on the photosensitive member surface in a size causative of faulty images and on the growth of such scratches, the present inventors have discovered that fine depressed portions may be so arranged on the electrophotographic photosensitive member surface as to fulfill certain conditions and this can effectively keep the electrophotographic photosensitive member surface from coming scratched in a size causative of faulty images and keep scratches from growing. Thus, they have accomplished the present invention.

More specifically, the present invention is concerned with an electrophotographic photosensitive member having a support and provided thereon a photosensitive layer, wherein, the electrophotographic photosensitive member has a surface having a plurality of depressed portions which are independent from one another, the depressed portions each have i) a surface opening having a major-axis diameter Rpc of from 0.1 μm or more to 10 μm or less and a minor-axis diameter Lpc of from 0.1 μm or more to 10 μm or less and ii) a distance Rdv between the deepest part of each depressed portion and the opening thereof, of from 0.1 μm or more to 10 μm or less, and where the surface of the electrophotographic photosensitive member is equally divided into 4 regions in the rotational direction of the photosensitive member, which are then equally divided into 25 regions in the direction falling at right angles with the rotational direction of the photosensitive member, to obtain 100-spot regions A in total, and, in each of the regions A, square regions B of 50 μm each per side one side of which is parallel to the rotational direction of the photosensitive member are provided and each of the regions B is equally divided into 500 zones by 499 straight lines parallel to the rotational direction of the photosensitive member, from 400 lines or more to 499 lines or less among the 499 lines pass through the depressed portions in each of the regions B.

The present invention is also concerned with a process cartridge having the above electrophotographic photosensitive member, and at least one device selected from the group consisting of a charging device, a developing device and a cleaning device; the process cartridge being detachably mountable to the main body of an electrophotographic apparatus.

The present invention is still also concerned with an electrophotographic apparatus having the above electrophotographic photosensitive member, a charging device, an exposure device, a developing device and a transfer device.

According to the present invention, it can keep the electrophotographic photosensitive member surface from coming scratched in a size causative of faulty images and keep scratches from growing, without relying on any method of improving mechanical strength, and this can provide an electrophotographic photosensitive member which can form good images over a long period of time, and a process cartridge and an electrophotographic apparatus which have such an electrophotographic photosensitive member.

Further features of the present invention will become apparent from the following description of exemplary embodiments with reference to the attached drawings.

DESCRIPTION OF THE EMBODIMENTS

Figure 1A:
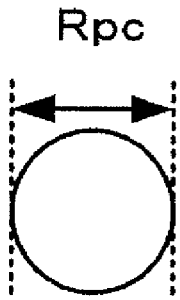
FIG. 1A is a view showing an example of a top-view shape of a depressed portion in the present invention. A bidirectional arrow in the drawing indicates the major-axis diameter Rpc of the depressed portion.
Figure 1B:
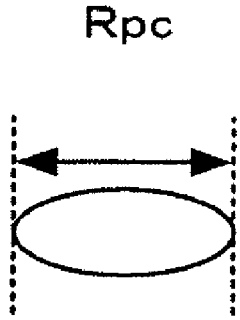
FIG. 1B is a view showing an example of a top-view shape of a depressed portion in the present invention. A bidirectional arrow in the drawing indicates the major-axis diameter Rpc of the depressed portion.
Figure 1C:
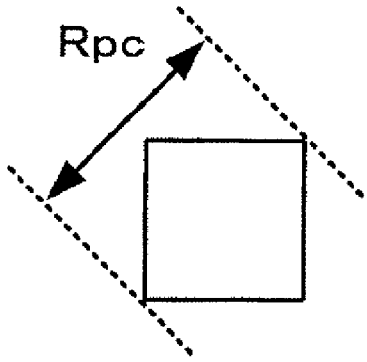
FIG. 1C is a view showing an example of a top-view shape of a depressed portion in the present invention. A bidirectional arrow in the drawing indicates the major-axis diameter Rpc of the depressed portion.
Figure 1D:
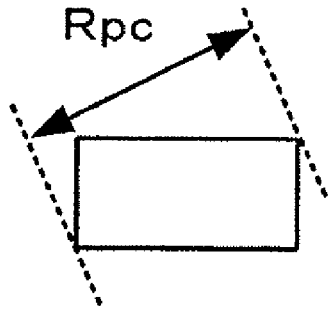
FIG. 1D is a view showing an example of a top-view shape of a depressed portion in the present invention. A bidirectional arrow in the drawing indicates the major-axis diameter Rpc of the depressed portion.
Figure 1E:
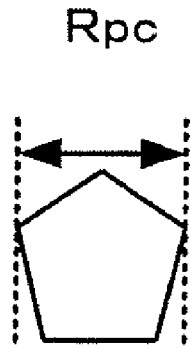
FIG. 1E is a view showing an example of a top-view shape of a depressed portion in the present invention. A bidirectional arrow in the drawing indicates the major-axis diameter Rpc of the depressed portion.
Figure 1F:
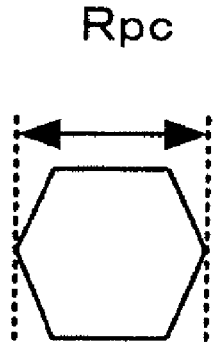
FIG. 1F is a view showing an example of a top-view shape of a depressed portion in the present invention. A bidirectional arrow in the drawing indicates the major-axis diameter Rpc of the depressed portion.
Figure 1G:
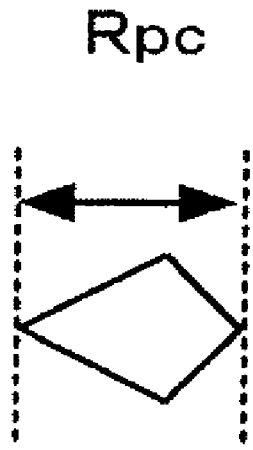
FIG. 1G is a view showing an example of a top-view shape of a depressed portion in the present invention. A bidirectional arrow in the drawing indicates the major-axis diameter Rpc of the depressed portion.
Figure 1H:
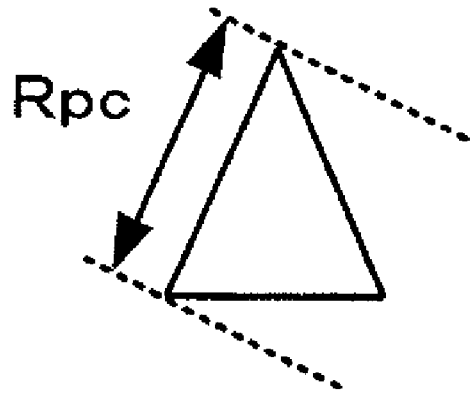
FIG. 1H is a view showing an example of a top-view shape of a depressed portion in the present invention. A bidirectional arrow in the drawing indicates the major-axis diameter Rpc of the depressed portion.
Figure 2A:
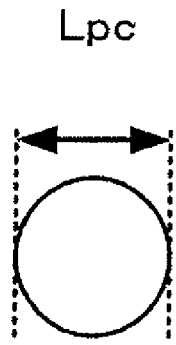
FIG. 2A is a view showing an example of a top-view shape of a depressed portion in the present invention. A bidirectional arrow in the drawing indicates the minor-axis diameter Lpc of the depressed portion.
Figure 2B:
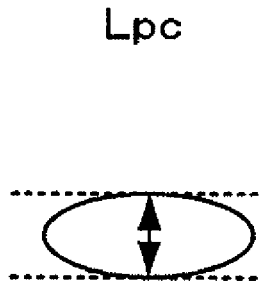
FIG. 2B is a view showing an example of a top-view shape of a depressed portion in the present invention. A bidirectional arrow in the drawing indicates the minor-axis diameter Lpc of the depressed portion.
Figure 2C:
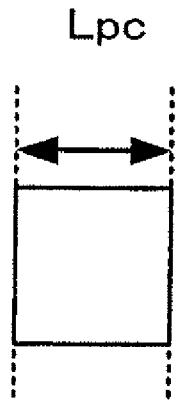
FIG. 2C is a view showing an example of a top-view shape of a depressed portion in the present invention. A bidirectional arrow in the drawing indicates the minor-axis diameter Lpc of the depressed portion.
Figure 2D:
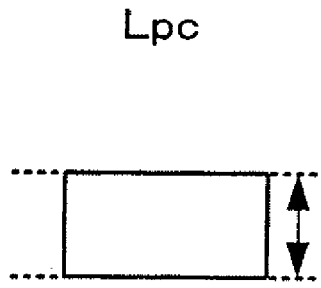
FIG. 2D is a view showing an example of a top-view shape of a depressed portion in the present invention. A bidirectional arrow in the drawing indicates the minor-axis diameter Lpc of the depressed portion.
Figure 2E:
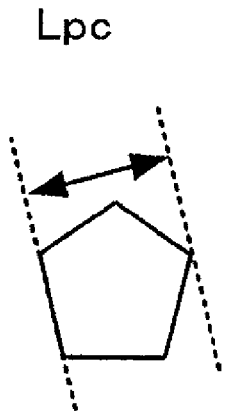
FIG. 2E is a view showing an example of a top-view shape of a depressed portion in the present invention. A bidirectional arrow in the drawing indicates the minor-axis diameter Lpc of the depressed portion.
Figure 2F:
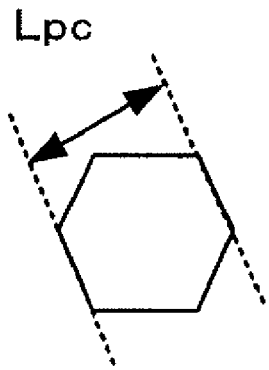
FIG. 2F is a view showing an example of a top-view shape of a depressed portion in the present invention. A bidirectional arrow in the drawing indicates the minor-axis diameter Lpc of the depressed portion.
Figure 2G:
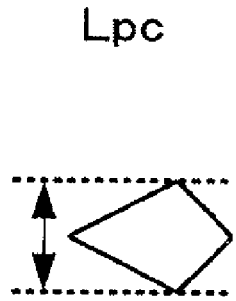
FIG. 2G is a view showing an example of a top-view shape of a depressed portion in the present invention. A bidirectional arrow in the drawing indicates the minor-axis diameter Lpc of the depressed portion.
Figure 2H:
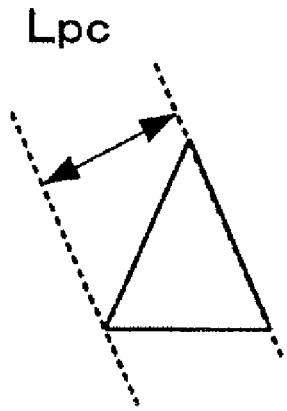
FIG. 2H is a view showing an example of a top-view shape of a depressed portion in the present invention. A bidirectional arrow in the drawing indicates the minor-axis diameter Lpc of the depressed portion.
Figure 3A:
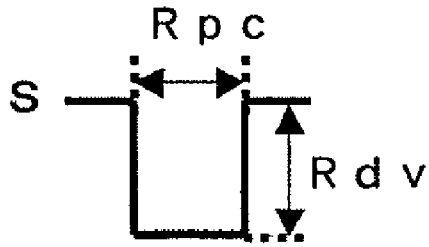
FIG. 3A is a view showing an example of a sectional shape of a depressed portion in the present invention. Bidirectional arrows in the drawing indicates the major-axis diameter Rpc and deepest-part to opening distance Rdv of the depressed portion.
Figure 3B:
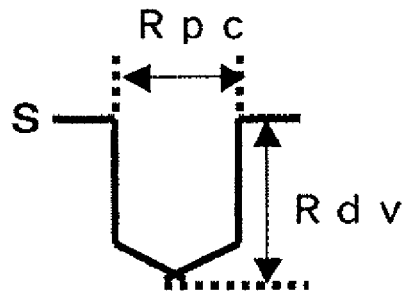
FIG. 3B is a view showing an example of a sectional shape of a depressed portion in the present invention. Bidirectional arrows in the drawing indicates the major-axis diameter Rpc and deepest-part to opening distance Rdv of the depressed portion.
Figure 3C:
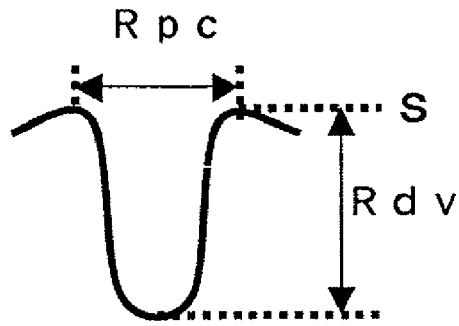
FIG. 3C is a view showing an example of a sectional shape of a depressed portion in the present invention. Bidirectional arrows in the drawing indicates the major-axis diameter Rpc and deepest-part to opening distance Rdv of the depressed portion.
Figure 3D:
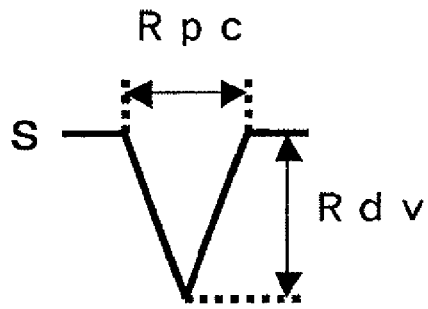
FIG. 3D is a view showing an example of a sectional shape of a depressed portion in the present invention. Bidirectional arrows in the drawing indicates the major-axis diameter Rpc and deepest-part to opening distance Rdv of the depressed portion.
Figure 3E:
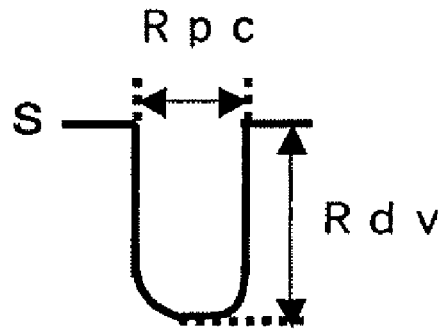
FIG. 3E is a view showing an example of a sectional shape of a depressed portion in the present invention. Bidirectional arrows in the drawing indicates the major-axis diameter Rpc and deepest-part to opening distance Rdv of the depressed portion.
Figure 3F:
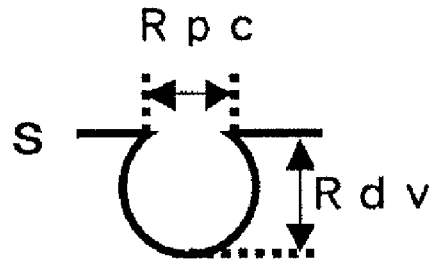
FIG. 3F is a view showing an example of a sectional shape of a depressed portion in the present invention. Bidirectional arrows in the drawing indicates the major-axis diameter Rpc and deepest-part to opening distance Rdv of the depressed portion.
Figure 3G:
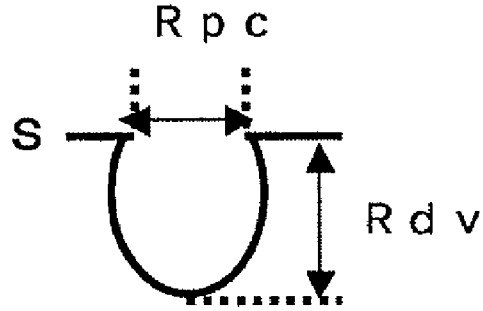
FIG. 3G is a view showing an example of a sectional shape of a depressed portion in the present invention. Bidirectional arrows in the drawing indicates the major-axis diameter Rpc and deepest-part to opening distance Rdv of the depressed portion.

The present invention is described below in greater detail.

The electrophotographic photosensitive member of the present invention is, as summarily described above, an electrophotographic photosensitive member having a support and provided thereon a photosensitive layer, wherein, the electrophotographic photosensitive member has a surface having a plurality of depressed portions which are independent from one another, the depressed portions each have i) a surface opening having a major-axis diameter Rpc of from 0.1 μm or more to 10 μm or less and a minor-axis diameter Lpc of from 0.1 μm or more to 10 μm or less and ii) a distance Rdv between the deepest part of each depressed portion and the opening thereof, of from 0.1 μm or more to 10 μm or less, and where the surface of the electrophotographic photosensitive member is equally divided into 4 regions in the rotational direction of the photosensitive member, which are then equally divided into 25 regions in the direction falling at right angles with the rotational direction of the photosensitive member, to obtain 100-spot regions A in total, and, in each of the regions A, square regions B of 50 μm each per side one side of which is parallel to the rotational direction of the photosensitive member are provided and each of the regions B is equally divided into 500 zones by 499 straight lines parallel to the rotational direction of the photosensitive member, from 400 lines or more to 499 lines or less among the 499 lines pass through the depressed portions in each of the regions B.

The depressed portions in the present invention which are independent from one another refer to depressed portions which individually stand clearly separated from other depressed portions. The depressed portions formed on the surface of the electrophotographic photosensitive member in the present invention may include, e.g., in the observation of the photosensitive member surface, those having a shape in which they are each constituted of straight lines, those having a shape in which they are each constituted of curved lines, and those having a shape in which they are each constituted of straight lines and curved lines. The shape in which they are constituted of straight lines may include, e.g., triangles, quadrangles, pentagons and hexagons. The shape in which they are constituted of curved lines may include, e.g., circles and ellipses. The shape in which they are constituted of straight lines and curved lines may include, e.g., quadrangles with round corners, hexagons with round corners, and sectors.

The depressed portions of the surface of the electrophotographic photosensitive member in the present invention may also include, e.g., in the observation of the photosensitive member cross section, those having a shape in which they are each constituted of straight lines, those having a shape in which they are each constituted of curved lines, and those having a shape in which they are each constituted of straight lines and curved lines. The shape in which they are constituted of straight lines may include, e.g., triangles, quadrangles and pentagons. The shape in which they are constituted of curved lines may include, e.g., partial circles and partial ellipses. The shape in which they are constituted of straight lines and curved lines may include, e.g., quadrangles with round corners, and sectors.

As specific examples of the depressed portions of the electrophotographic photosensitive member surface in the present invention, they may include depressed portions shown in FIGS. 1A to 1H, FIGS. 2A to 2H and FIGS. 3A to 3G. The depressed portions of the electrophotographic photosensitive member surface in the present invention may individually have different shapes, sizes and depths. They may also all have the same shape, size and depth. The surface of the electrophotographic photosensitive member may further be a surface having in combination the depressed portions which individually have different shapes, sizes and depths and the depressed portions which have the same shape, size and depth.

The major-axis diameter in the present invention refers to the length of a straight line which is longest among straight lines crossing the opening of each depressed portion. Stated specifically, as shown by major-axis diameter Rpc in FIGS. 1A to 1H and by major-axis diameter Rpc in FIGS. 3A to 3G, it refers to the length found when, on the basis of the surface that surrounds openings of the depressed portions of the surface of the electrophotographic photosensitive member, and where a depressed portion is put between parallel two straight lines that touch the edge of an opening of the depressed portion, the distance between these two straight lines comes maximum. For example, where a depressed portion has a top-view shape of a circle, the major-axis diameter refers to the diameter. Where a depressed portion has a top-view shape of an ellipse, the major-axis diameter refers to the longer diameter. Where a depressed portion has a top-view shape of a quadrangle, the major-axis diameter refers to the longer diagonal line among diagonal lines.

The minor-axis diameter in the present invention refers to the length of a straight line which is shortest among straight lines crossing the opening of each depressed portion. Stated specifically, as shown by minor-axis diameter Lpc in FIGS. 2A to 2H, it refers to the length found when, on the basis of the surface that surrounds openings of the depressed portions of the surface of the electrophotographic photosensitive member, and where a depressed portion is put between parallel two straight lines that touch the edge of an opening of the depressed portion, the distance between these two straight lines comes minimum. For example, where a depressed portion has a top-view shape of a circle, the major-axis diameter refers to the diameter. Where a depressed portion has a top-view shape of an ellipse, the major-axis diameter refers to the shorter diameter.

The distance Rdv between the deepest part of each depressed portion and the opening thereof in the present invention refers to, as shown by depth Rdv in FIGS. 3's, the distance between the deepest part of each depressed portion and the opening thereof, i.e., the depth, on the basis of the surface that surrounds openings of the depressed portions of the surface of the electrophotographic photosensitive member.

In order to keep the electrophotographic photosensitive member from coming scratched at its photosensitive layer surface in a size causative of faulty images and keep scratches from growing, the depressed portions are formed at least on the photosensitive layer surface of the electrophotographic photosensitive member.

The depressed portions are present in such a way that, where the surface of the electrophotographic photosensitive member is equally divided into 4 regions in the rotational direction of the photosensitive member, which are then equally divided into 25 regions in the direction falling at right angles with the rotational direction of the photosensitive member, to obtain 100-spot regions A in total, and, in each of the regions A, square regions B of 50 μm each per side one side of which is parallel to the rotational direction of the photosensitive member are provided and each of the regions B is equally divided into 500 zones by 499 straight lines parallel to the rotational direction of the photosensitive member, from 400 lines or more to 499 lines or less among the 499 straight lines pass through the depressed portions in each of the regions B.

Figure 4:
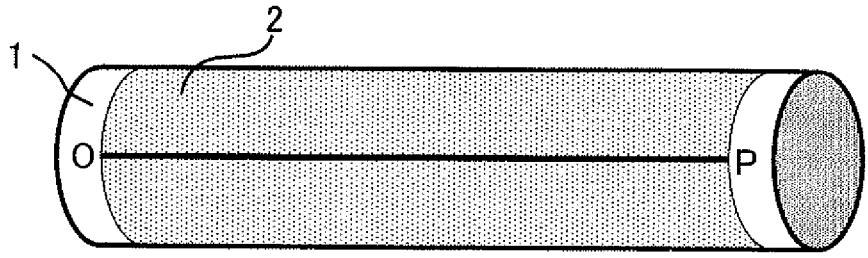
FIG. 4 is a view showing a support 1 and a photosensitive layer 2 provided on the support in the electrophotographic photosensitive member of the present invention. (A straight line O-P in the drawing is a straight line falling at right angles with the photosensitive member rotational direction on the photosensitive layer.)
Figure 5:
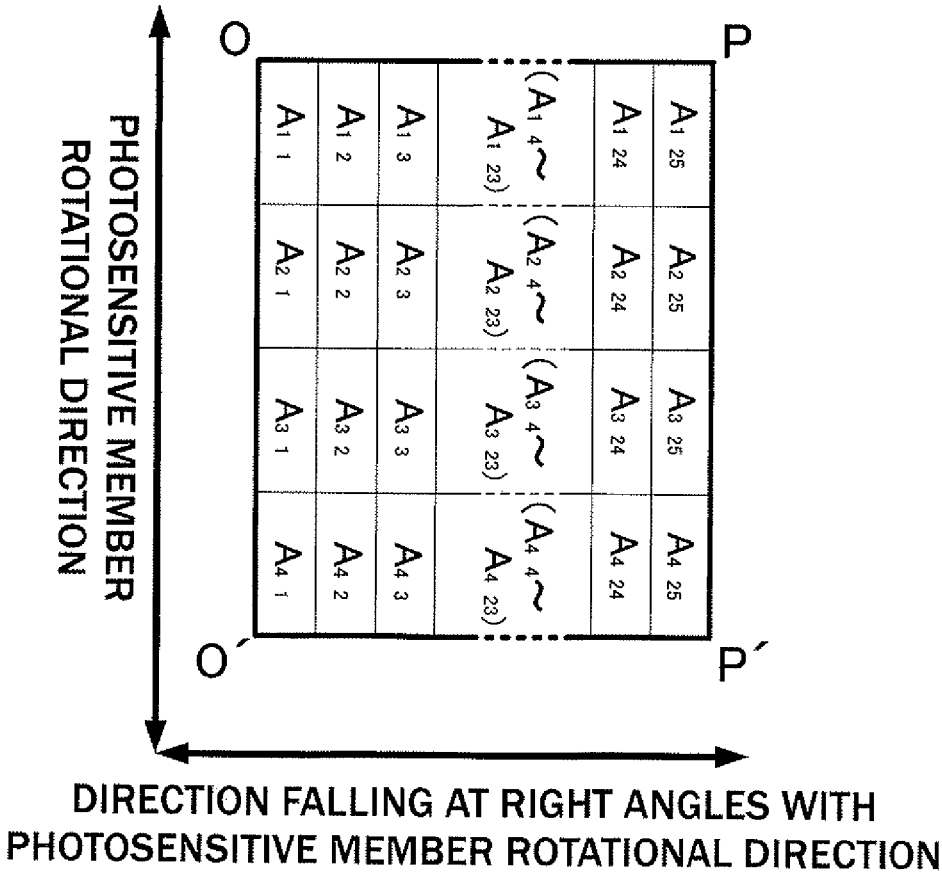
FIG. 5 is a view showing how to assign the regions A in the present invention. (It shows part of the regions A in abbreviation.

How to assign the regions A is described with reference to FIGS. 4 and 5. A photosensitive layer surface 2 in the electrophotographic photosensitive member shown in FIG. 4 is cut along a straight line O-P extending in the direction falling at right angles with the photosensitive member rotational direction on the photosensitive layer surface and then spread to obtain what is shown in FIG. 5. A point O' and a point P' in FIG. 5 are points which stood adjoined a point O and a point P, respectively, before the layer is cut and spread. A quadrangle formed by O-P-P'-O' is equally divided into 4 regions in the rotational direction of the photosensitive member, which are then equally divided into 25 regions in the direction falling at right angles with the rotational direction of the photosensitive member, whereby 100-spot regions A in total can be assigned as shown in FIG. 5. (FIG. 5 shows part of the regions A in abbreviation.)

Figure 6:
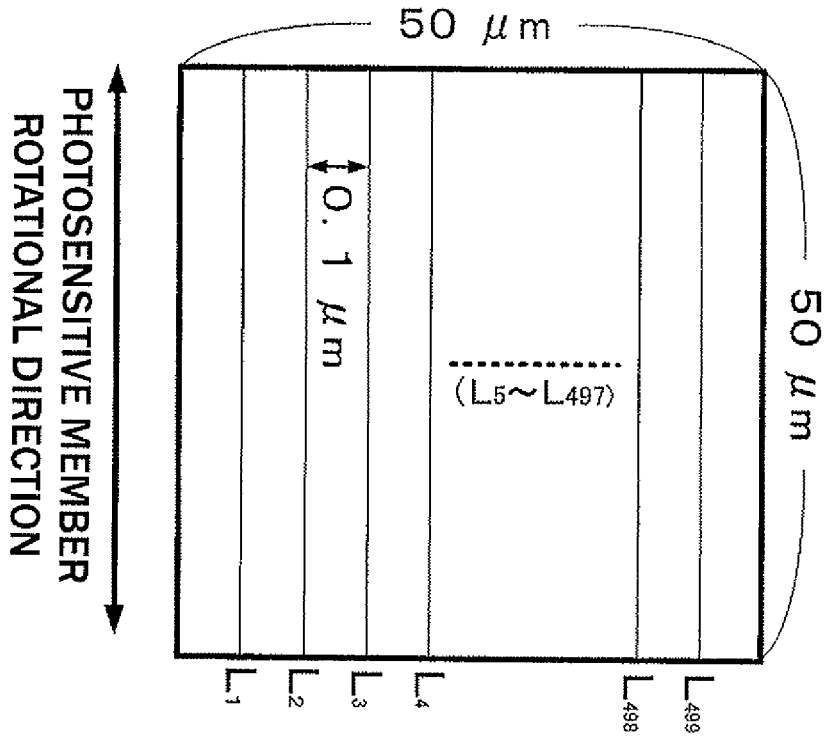
FIG. 6 is a view showing a region B equally divided into 500 zones by 499 straight lines parallel to the photosensitive member rotational direction. (Only part of the straight lines are shown in the drawing.)

The regions B to be provided in the regions A thus obtained are each equally divided into 500 zones by 499 straight lines in total which are straight lines $L_1$ to $L_{499}$ parallel to the rotational direction of the photosensitive member, to obtain what is shown in FIG. 6. As shown by a bidirectional arrow in FIG. 6, the interval between the straight lines each is 0.1 μm.

Figure 7:
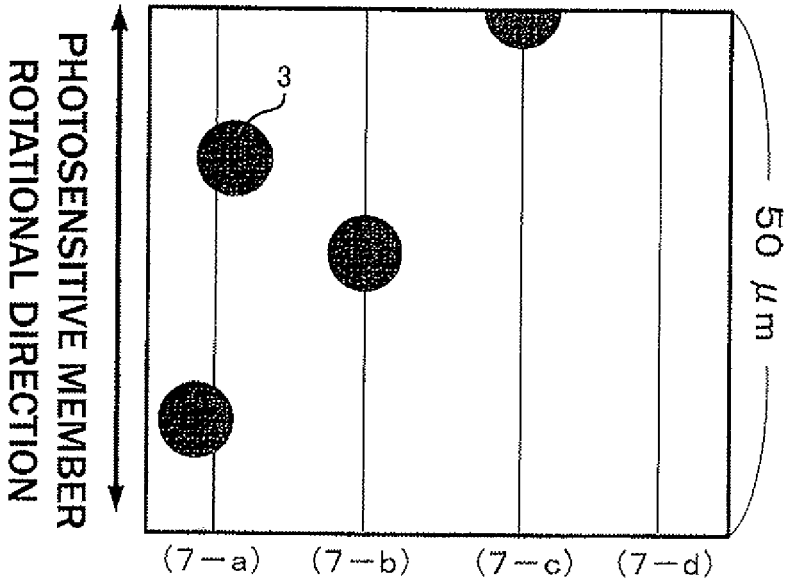
FIG. 7 is a view showing an example of how the straight lines in a region B in the present invention pass through the depressed portions.

In regard to how the straight lines in each region B pass through the depressed portions, it is described with reference to FIG. 7. That the straight lines in the region B in the present invention pass through depressed portions 3 specifically shows states shown by (7-*a*), (7-*b*) and (7-*c*) in FIG. 7. That, in reverse, the straight lines in the region B do not pass through any depressed portions specifically shows a state shown by (7-d) in FIG. 7. In the present invention, where a straight line in the region B passes through even at least some part of one or more depressed portion(s), the straight line is counted as a straight line passing through the depressed portion(s).

In the electrophotographic photosensitive member that fulfills the above conditions, it can effectively keep the whole photosensitive layer surface from coming scratched in a size causative of faulty images and keep scratches from growing.

In recent years, electrophotographic photosensitive members used commonly may include cylindrical or belt-shaped electrophotographic photosensitive members. In such electrophotographic photosensitive members, part or the whole of a sequential image formation process of charging, development, transfer and cleaning can continuously be performed with the rotation of the photosensitive member. The photosensitive member is often used in the state it is in contact with a charging member, a developing member, a transfer member and a cleaning member during the above image formation process.

In the case when the photosensitive member and a member other than the photosensitive member come into contact with each other, the photosensitive member surface is considered to be affected differently between the photosensitive member rotational direction and the direction falling at right angles with the photosensitive member rotational direction, in view of characteristics of the movement referred to as the rotation. In any of a case in which the photosensitive member and a member other than the photosensitive member are follow-up driven, a case in which the photosensitive member and a member other than the photosensitive member are individually independently rotated and a case in which only one part of the photosensitive member and a member other than the photosensitive member is rotated, a larger force is considered to be applied to the photosensitive member surface in the photosensitive member rotational direction than in the direction falling at right angles with the photosensitive member rotational direction. This is because frictional force acts greatly in the rotational direction during the rotation of the photosensitive member. Such great frictional force acts repeatedly in the photosensitive member rotational direction. Hence, where the photosensitive member surface has come finely scratched, the frictional force subsequently acting repeatedly makes such fine scratches grow gradually in the photosensitive member rotational direction, until they come into large scratches extending in the photosensitive member rotational direction which are called peripheral scratches. Some large ones among such scratches can be detected by visual observation of the photosensitive member surface. Once the photosensitive member surface has come finely scratched and the scratches thus made have become larger because of the force of friction acting repeatedly, it comes about that the process of charging, development, transfer and cleaning is non-uniformly performed around the scratches made on the photosensitive member, resulting in a lowering of image quality.

In the present invention, the electrophotographic photosensitive member has on its surface the specific depressed portions. This not only makes the photosensitive member surface less come finely scratched but also makes any resultant fine scratches less grow larger than the size causative of faulty images in the direction parallel to the photosensitive member rotational direction, to prevent image quality from lowering because of the scratches that may grow in the photosensitive member rotational direction. Such a method is herein presented. More specifically, in the electrophotographic photosensitive member of the present invention, even where the photosensitive member surface has come finely scratched as a result of its contact with other members and such fine scratches made as a result of the repetition of contact with other members have grown in the photosensitive member rotational direction, the scratches are stopped from further growing, at the stage where the growth of scratches has reached the depressed portions of the photosensitive member surface, to keep the scratches from growing to have the size causative of a lowering of image quality.

The electrophotographic photosensitive member of the present invention has, on the electrophotographic photosensitive member surface, a plurality of depressed portions which are independent from one another and each have i) a surface opening having a major-axis diameter Rpc of from 0.1 μm or more to 10 μm or less and a minor-axis diameter Lpc of from 0.1 μm or more to 10 μm or less and ii) a deepest-part to opening distance Rdv of from 0.1 μm or more to 10 μm or less. As having such depressed portions, even where the fine scratches made on the electrophotographic photosensitive member surface have grown in the photosensitive member rotational direction, the scratches are stopped from growing at a point of time where the scratches have reached the depressed portions, thus the scratches can be stopped at the depressed portions from growing further.

Further, in the electrophotographic photosensitive member of the present invention, where the surface of the electrophotographic photosensitive member is equally divided into 4 regions in the rotational direction of the photosensitive member, which are then equally divided into 25 regions in the direction falling at right angles with the rotational direction of the photosensitive member, to obtain 100-spot regions A in total, and, in each of the regions A, square regions B of 50 μm each per side one side of which is parallel to the rotational direction of the photosensitive member are provided and each of the regions B is equally divided into 500 zones by 499 straight lines parallel to the rotational direction of the photosensitive member, from 400 lines or more to 499 lines or less among the 499 straight lines pass through the depressed portions in each of the regions B. The photosensitive member that fulfills this condition is an electrophotographic photosensitive member on the whole photosensitive member surface area of which the depressed portions are present within the range where they make the scratches not grow in the photosensitive member rotational direction to have the size causative of a lowering of image quality. Thus, even where the photosensitive member surface has come finely scratched and such scratches have extended in the photosensitive member rotational direction, the depressed portions are present at both ends of scratches in their photosensitive member rotational direction and also present at intervals within the range where they make the scratches not grow in the photosensitive member rotational direction to have the size causative of a lowering of image quality, and hence this makes image quality less deteriorate because of the growth of scratches.

The depressed portions in the present invention each have the major-axis diameter Rpc of from 0.1 μm or more to 10 μm or less, which may preferably be from 0.5 μm or more to 9.0 μm or less.

The depressed portions in the present invention each have the minor-axis diameter Lpc of from 0.1 μm or more to 10 μm or less, which may preferably be from 0.4 μm or more to 9.0 μm or less.

The depressed portions in the present invention each have the distance Rdv between the deepest part of each depressed portion and the opening thereof (deepest-part to opening distance Rdv), of from 0.1 μm or more to 10 μm or less, which may preferably be from 0.5 μm or more to 5.0 μm or less.

The depressed portions in the present invention may each preferably have a ratio of the deepest-part to opening distance Rdv to the major-axis diameter Rpc, Rdv/Rpc, in a value of from 0.1 or more to 10 or less.

The depressed portions in the present invention may also be such that from 450 lines or more to 499 lines or less among the 499 straight lines pass through the depressed portions in each of the regions B. This is more preferable in order to enhance the effect of keeping from growing the fine scratches made on the photosensitive member surface.

In the present invention, the depressed portions of the surface of the electrophotographic photosensitive member may be measured with a commercially available laser microscope, optical microscope, electron microscope or atomic force microscope.

As the laser microscope, the following equipment may be used, for example. An ultradepth profile measuring microscope VK-8550, an ultradepth profile measuring microscope VK-9000 and an ultradepth profile measuring microscope VK-9500 (all manufactured by Keyence Corporation), a profile measuring system SURFACE EXPLORER SX-520DR model instrument (manufactured by Ryoka Systems Inc.), a scanning confocal laser microscope OLS3000 (manufactured by Olympus Corporation), and a real-color confocal microscope OPTELICS C130 (manufactured by Lasertec Corporation).

As the optical microscope, the following equipment may be used, for example. A digital microscope VHX-500 and a digital microscope VHX-200 (both manufactured by Keyence Corporation), and a 3D digital microscope VC-7700 (manufactured by Omron Corporation).

As the electron microscope, the following equipment may be used, for example. A 3D real surface view microscope VE-9800 and a 3D real surface view microscope VE-8800 (both manufactured by Keyence Corporation), a scanning electron microscope Conventional/Variable Pressure System SEM (manufactured by SII Nano Technology Inc.), and a scanning electron microscope SUPERSCAN SS-550 (manufactured by Shimadzu Corporation).

As the atomic force microscope, the following equipment may be used, for example. A nanoscale hybrid microscope VN-8000 (manufactured by Keyence Corporation), a scanning probe microscope NanoNavi Station (manufactured by SII Nano Technology Inc.), and a scanning probe microscope SPM-9600 (manufactured by Shimadzu Corporation).

Using the above microscope, the major-axis diameter Rpc, the minor-axis diameter Lpc and the deepest-part to opening distance Rdv may be observed at stated magnifications to measure these.

Incidentally, as to depressed portions of about 1 μm or less in major-axis diameter, these may be observed with the laser microscope and the optical microscope. However, where measurement precision should be more improved, it is desirable to use observation and measurement with the electron microscope in combination.

How to process the surface of the electrophotographic photosensitive member according to the present invention is described next. As methods for forming surface profiles, there are no particular limitations as long as they are methods that can satisfy the above requirements concerned with the depressed portions. To give examples of how to process the surface of the electrophotographic photosensitive member, available are a method of processing the surface of the electrophotographic photosensitive member by irradiation with a laser having as its output characteristics a pulse width of 100 ns (nanoseconds) or less, a method of processing the surface by bringing a mold (profile-providing material) having a stated surface profile into pressure contact with the surface of the electrophotographic photosensitive member to effect surface profile transfer, and a method of processing the surface by causing condensation to take place on the surface of the electrophotographic photosensitive member when its surface layer is formed.

The method of processing the surface of the electrophotographic photosensitive member by irradiation with a laser having as its output characteristics a pulse width of 100 ns (nanoseconds) or less is described first. As examples of the laser used in this method, it may include an excimer laser making use of a gas such as ArF, KrF, XeF or XeCl as a laser medium, and a femtosecond laser making use of titanium sapphire as a laser medium. Further, the laser light in the above laser irradiation may preferably have a wavelength of 1,000 nm or less.

The excimer laser is a laser from which the light is emitted through the following steps. First, a mixed gas of a rare gas such as Ar, Kr or Xe and a halogen gas such as F or Cl is provided with high energy by discharge, electron beams or X-rays to excite and combine the above elements. Thereafter, the energy comes down to the ground state to cause dissociation, during which the excimer laser light is emitted. The gas used in the excimer laser may include ArF, KrF, XeCl and XeF, any of which may be used. In particular, KrF or ArF is preferred.

Figure 8:
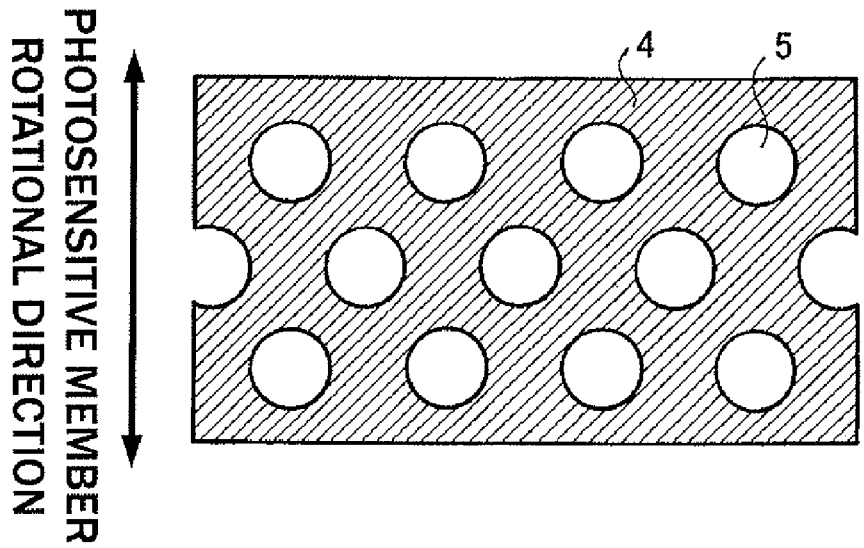
FIG. 8 is a partial enlarged view showing an example of an arrangement pattern of a laser mask in the present invention.
Figure 9:
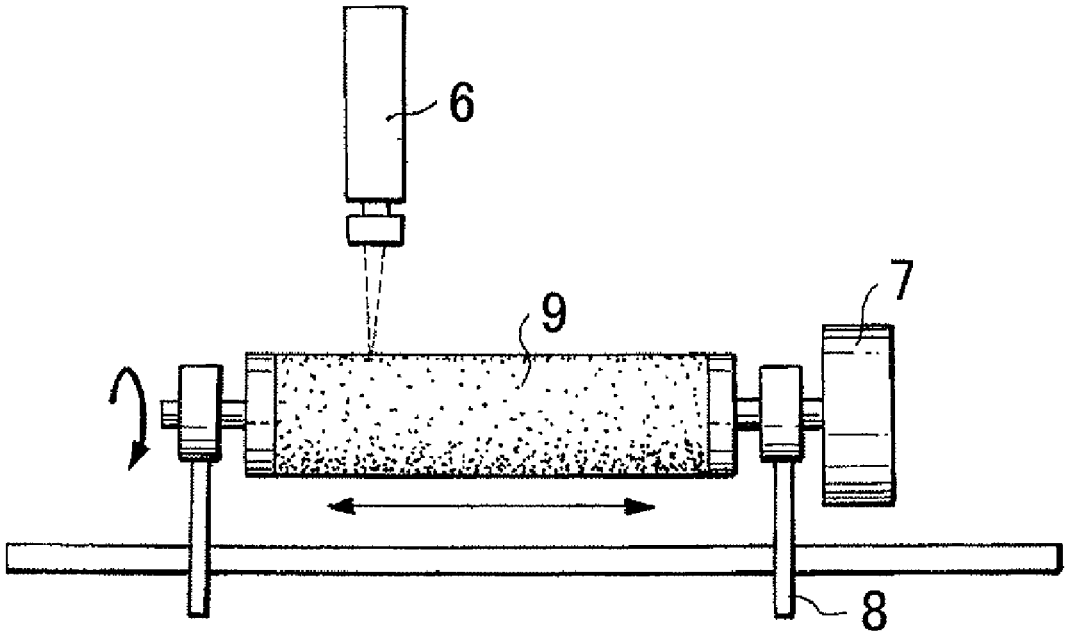
FIG. 9 is a schematic view showing an example of a laser surface processing unit in the present invention.

As a method of forming the depressed portions, a mask is used in which laser light shielding areas 4 and laser light transmitting areas 5 are appropriately arranged as shown in FIG. 8. Only the laser light having been transmitted through the mask is converged with a lens, and the surface of the electrophotographic photosensitive member is irradiated with that light. This enables formation of the depressed portions having the desired shape and arrangement. In the above method of processing the surface of the electrophotographic photosensitive member by laser irradiation, surface processing can instantly and simultaneously be carried out to form a large number of depressed portions in a certain area, without regard to the shape or area of the depressed portions. Hence, the step of processing the surface can be carried out in a short time. By the laser irradiation making use of such a mask, the surface of the electrophotographic photosensitive member is processed in its region of from several $mm^2$ to several $cm^2$ per irradiation made once. In such laser processing, first, as shown in FIG. 9, an electrophotographic photosensitive member 9 is rotated by means of a work rotating motor 7. With its rotation, the laser irradiation position of an excimer laser light irradiator 6 is shifted in the axial direction of the electrophotographic photosensitive member 9 by means of a work shifting unit 8. This enables formation of the depressed portions in a good efficiency over the whole surface region of the electrophotographic photosensitive member.

The above method of processing the surface of the electrophotographic photosensitive member by laser irradiation can produce the electrophotographic photosensitive member in which the surface has a plurality of depressed portions which are independent from one another and each have a major-axis diameter Rpc of from 0.1 μm or more to 10 μm or less, a minor-axis diameter Lpc of from 0.1 μm or more to 10 μm or less and a deepest-part to opening distance Rdv of from 0.1 μm or more to 10 μm or less, and, where the surface of the electrophotographic photosensitive member is equally divided into 4 regions in the photosensitive member rotational direction, which are then equally divided into 25 regions in the direction falling at right angles with the photosensitive member rotational direction, to obtain 100-spot regions A in total, and, in each of the regions A, square regions B of 50 μm each per side one side of which is parallel to the photosensitive member rotational direction are provided and each of the regions B is equally divided into 500 zones by 499 straight lines parallel to the photosensitive member rotational direction, from 400 lines or more to 499 lines or less among the 499 lines pass through the depressed portions in each of the regions B.

In the case when the surface of the electrophotographic photosensitive member is processed by laser irradiation, the deepest-part to opening distance may be controlled by adjusting production conditions such as time for, and number of times of, laser irradiation. From the viewpoint of precision in manufacture or productivity, in the case when the surface of the electrophotographic photosensitive member is processed by laser irradiation, the depressed portions formed by irradiation made once may preferably be in a distance between the deepest part of each depressed portion and the opening thereof, of from 0.1 μm or more to 2.0 μm or less, and more preferably from 0.3 μm or more to 1.2 μm or less.

Figure 10:
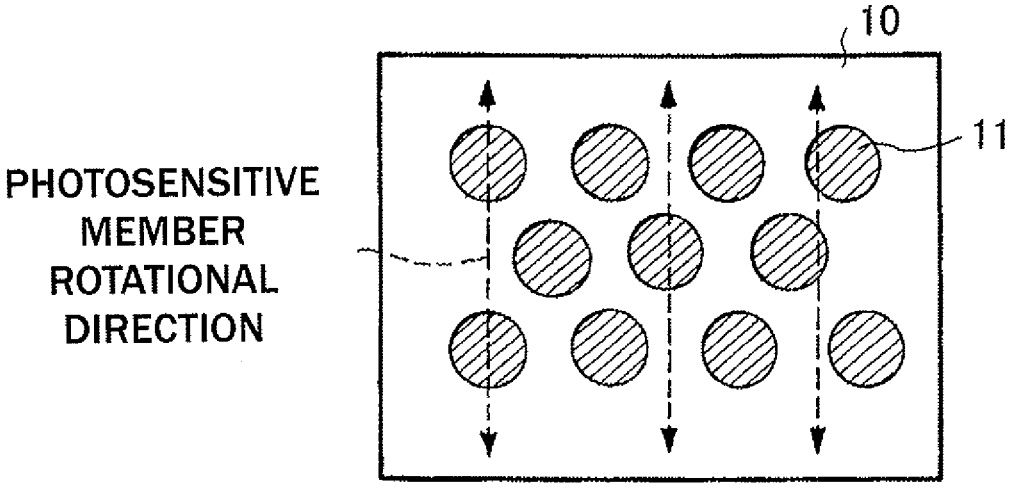
FIG. 10 is a partial enlarged view showing an example of an arrangement pattern of depressed portions of the photosensitive member outermost surface obtained according to the present invention.

An example of the depressed portions that can be formed on the electrophotographic photosensitive member surface by the above method is shown in FIG. 10. In FIG. 10, reference numeral 11 denotes the depressed portion-formed areas; and 10, no-depressed-portion-formed areas. Bidirectional arrows indicate the rotational direction of the electrophotographic photosensitive member. The employment of the method of processing the surface of the electrophotographic photosensitive member by laser irradiation enables materialization of the surface processing of the electrophotographic photosensitive member in a high controllability for the size, shape and arrangement of the depressed portions, in a high precision and at a high degree of freedom.

The method of processing the surface by bringing a mold (profile-providing material) having a stated surface profile into pressure contact with the surface of the electrophotographic photosensitive member to effect surface profile transfer is described next.

Figure 11:
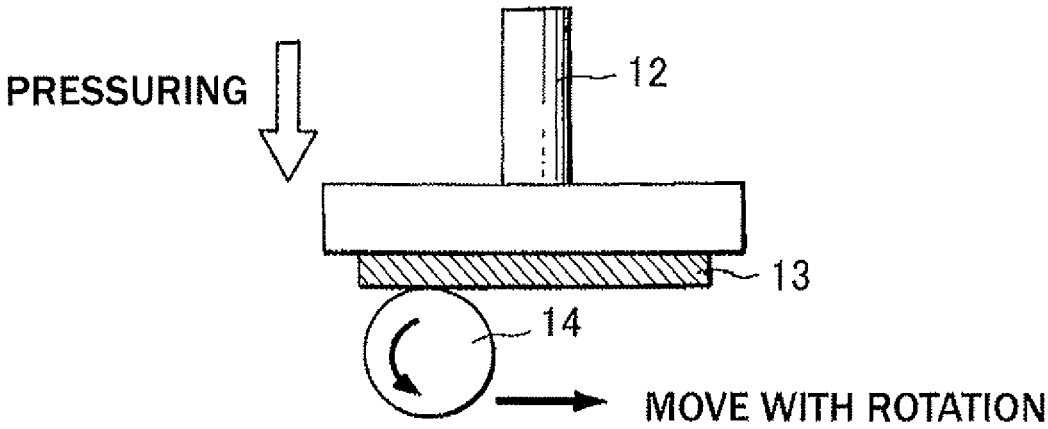
FIG. 11 is a schematic view showing an example of a pressure contact profile transfer surface processing unit making use of a mold serving as a profile-providing material in the present invention.

FIG. 11 is a schematic view showing an example of a pressure contact profile transfer surface processing unit making use of a mold as a profile-providing material usable in the present invention. A stated mold 13 is fitted to a pressuring unit 12 which can repeatedly perform pressuring and release, and thereafter the mold is brought into contact with an electrophotographic photosensitive member 14 at a stated pressure (shown by an arrow) to effect transfer of a surface profile. Thereafter, the pressuring is first released to make the electrophotographic photosensitive member 14 move with rotation in the direction shown by an arrow, and then pressuring is again performed to carry out the step of transferring the surface profile. Repeating this step enables formation of the stated depressed portions over the whole peripheral surface of the electrophotographic photosensitive member.

Figure 12:
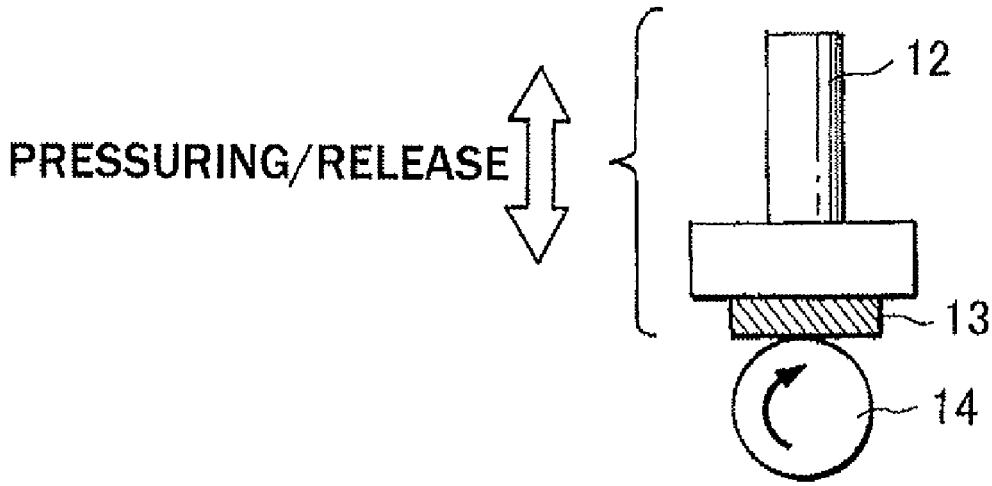
FIG. 12 is a view showing another example of a pressure contact profile transfer surface processing unit making use of a mold (profile-providing material) in the present invention.

Instead, as shown in FIG. 12 for example, a mold 13 having a stated surface profile for substantially the whole peripheral surface of the photosensitive member 14 may be fitted to the pressuring unit 12, and thereafter brought into contact with the photosensitive member 14 at a stated pressure, during which the photosensitive member is rotated and moved to form stated depressed portions over the whole peripheral surface of the photosensitive member.

As another method, a sheetlike mold may be held between a roll-shaped pressuring unit and the photosensitive member to process the photosensitive member surface while feeding the mold sheet.

For the purpose of effecting the surface profile transfer efficiently, the mold and the photosensitive member may be heated. The mold and the photosensitive member may be heated at any temperature as long as the stated depressed portions in the present invention can be formed. They may preferably be so heated that the temperature (° C.) of the mold at the time of surface profile transfer may be higher than the glass transition temperature (° C.) of the photosensitive layer on the support. Further, in addition to the heating of the mold, the temperature (° C.) of the support at the time of surface profile transfer may be kept controlled to be lower than the glass transition temperature (° C.) of the photosensitive layer. This is preferable in order to stably form the depressed portions to be transferred to the photosensitive member surface.

Where the photosensitive member of the present invention is a photosensitive member having a charge transport layer, the mold and the photosensitive member may preferably be so heated that the temperature (° C.) of the mold at the time of surface profile transfer may be higher than the glass transition temperature (° C.) of the charge transport layer on the support. Further, in addition to the heating of the mold, the temperature (° C.) of the support at the time of surface profile transfer may be kept controlled to be lower than the glass transition temperature (° C.) of the charge transport layer. This is preferable in order to stably form the depressed portions to be transferred to the electrophotographic photosensitive member surface.

Figure 13:
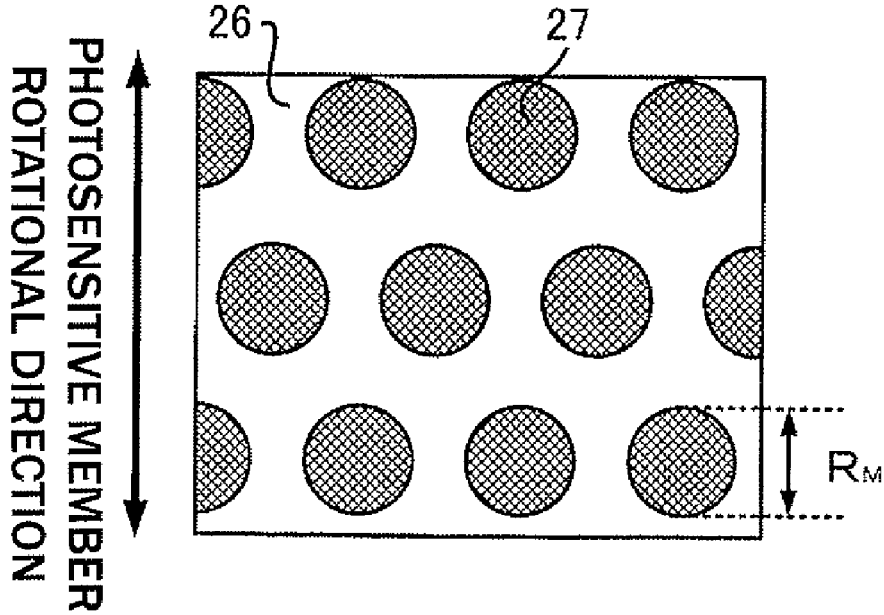
FIG. 13 is a partial enlarged view of the photosensitive member contact surface of the mold in the present invention, showing an example of its surface profile.

The material, size and surface profile of the mold itself may appropriately be selected. The material may include finely surface-processed metals and silicon wafers the surfaces of which have been patterned using a resist, and fine-particle-dispersed resin films or resin films having a stated fine surface profile which have been coated with a metal. Examples of the surface profile of the mold are shown in FIGS. 13 (a partial enlarged view of its photosensitive member contact surface) and 14 (a partial enlarged view of a cross section of its photosensitive member contact surface). In these drawings, reference numeral 26 denotes a substrate of the mold; and 27, columns of the mold.

An elastic member may also be provided between the mold and the pressuring unit for the purpose of providing the photosensitive member with pressure uniformity.

The above method of processing the surface by bringing a mold having a stated surface profile into pressure contact with the surface of the electrophotographic photosensitive member to effect surface profile transfer can produce the electrophotographic photosensitive member in which the surface has a plurality of depressed portions which are independent from one another and each have a surface opening having a major-axis diameter Rpc of from 0.1 μm or more to 10 μm or less and a minor-axis diameter Lpc of from 0.1 μm or more to 10 μm or less, and a deepest-part to opening distance Rdv of from 0.1 μm or more to 10 μm or less, and, where the surface of the electrophotographic photosensitive member is equally divided into 4 regions in the photosensitive member rotational direction, which are then equally divided into 25 regions in the direction falling at right angles with the photosensitive member rotational direction, to obtain 100-spot regions A in total, and, in each of the regions A, square regions B of 50 μm each per side one side of which is parallel to the photosensitive member rotational direction are provided and each of the regions B is equally divided into 500 zones by 499 straight lines parallel to the photosensitive member rotational direction, from 400 lines or more to 499 lines or less among the 499 lines pass through the depressed portions in each of the regions B.

The employment of the method of processing the surface by bringing a mold having a stated surface profile into pressure contact with the surface of the electrophotographic photosensitive member to effect surface profile transfer enables materialization of the surface processing of the electrophotographic photosensitive member in a high controllability for the size, shape and arrangement of the depressed portions, in a high precision and at a high degree of freedom.

The method of processing the surface by condensation occurring on the surface of the electrophotographic photosensitive member when its surface layer is formed is described next. The method of processing the surface by causing condensation to occur on the surface of the electrophotographic photosensitive member when its surface layer is formed is a method of producing an electrophotographic photosensitive member in which a surface layer coating solution containing a binder resin and a specific aromatic organic solvent and containing the aromatic organic solvent in an amount of from 50% by mass or more to 80% by mass or less based on the total mass of the solvent in the surface layer coating solution is prepared, and a surface layer on the surface of which the depressed portions independent from one another have been formed is produced through a coating step which coats a base member (the member as a base on which the surface layer is to be formed) with the coating solution, then a base member holding step which holds the base member coated with the coating solution and causes condensation to take place on the surface of the base member coated with the coating solution, and thereafter a drying step which heats and dries the base member on which surface condensation has occurred.

The above binder resin may include, e.g., acrylic resins, styrene resins, polyester resins, polycarbonate resins, polyarylate resins, polysulfone resins, polyphenylene oxide resins, epoxy resins, polyurethane resins, alkyd resins and unsaturated resins. In particular, polymethyl methacrylate resins, polystyrene resins, styrene-acrylonitrile copolymer resins, polycarbonate resins, polyarylate resins and diallyl phthalate resins are preferred. Polycarbonate resins or polyarylate resins are further preferred. Any of these may be used alone, or in the form of a mixture or copolymer of two or more types.

The above specific aromatic organic solvent is a solvent having a low affinity for water. It may specifically include 1,2-dimethylbenzene, 1,3-dimethylbenzene, 1,4-dimethylbenzene, 1,3,5-trimethylbenzene and chlorobenzene.

It is important that the above surface layer coating solution contains the aromatic organic solvent. The surface layer coating solution may further contain an organic solvent having a high affinity for water, or water, for the purpose of forming the depressed portions stably. As the organic solvent having a high affinity for water, it may preferably be (methylsulfinyl) methane (popular name: dimethyl sufloxide), thiolan-1,1-dione (popular name: sulfolane), N,N-diemthylcarboxyamide, N,N-diethylcarboxyamide, dimethylacetamide or 1-methylpyrrolidin-2-one. Any of these organic solvent may be contained alone or may be contained in the form of a mixture of two or more types.

The above base member holding step in which condensation takes place on the surface of the base member shows the step of holding the base member coated with the surface layer coating solution, for a certain time in an atmosphere in which condensation takes place on the surface of the base member. The condensation in this surface processing method shows that droplets have been formed on the base member coated with the surface layer coating solution, by the action of the water. Conditions under which the condensation takes place on the surface of the base member are influenced by relative humidity of the atmosphere in which the base member is to be held and evaporation conditions (e.g., vaporization heat) for the coating solution solvent. However, the surface layer coating solution contains the aromatic organic solvent in an amount of 50% by mass or more based on the total mass of the solvent in the surface layer coating solution. Hence, the conditions under which the condensation takes place on the surface of the base member are less influenced by the evaporation conditions for the coating solution solvent, and depend chiefly on the relative humidity of the atmosphere in which the base member is to be held. The relative humidity at which the condensation takes place on the surface of the base member may be from 40% to 100%. The relative humidity may further preferably be from 70% or more. Such a base member holding step may be given a time necessary for the droplets to be formed by the condensation. From the viewpoint of productivity, this time may preferably be from 1 second to 300 seconds, and may further preferably be approximately from 10 seconds to 180 seconds. The relative humidity is important for the base member holding step, and such an atmosphere may preferably have a temperature of from 20° C. or more to 80° C. or less.

Through the above drying step which dries the base member on which the condensation have taken place, the droplets produced on the surface through the base member holding step can be formed as the depressed portions of the photosensitive member surface. In order to form depressed portions with a high uniformity, it is important for the drying to be quick drying, and hence heat drying is carried out. Drying temperature in the drying step may preferably be from 100° C. to 150° C. As the time for the drying step which heats and dries the base member having been subjected to the condensation, a time may be given for which the solvent in the coating solution applied onto the base member and the water droplets formed through the condensation step can be removed. The time for the drying step may preferably be from 20 minutes to 120 minutes, and may further preferably be from 40 minutes to 100 minutes.

By the above method of processing the surface by the condensation on the surface of the electrophotographic photosensitive member when its surface layer is formed, the depressed portions independent from one another are formed on the surface of the photosensitive member. The method of processing the surface by the condensation on the surface of the electrophotographic photosensitive member when its surface layer is formed is a method in which the droplets to be formed by the action of water are formed using the solvent having a low affinity for water and the binder resin to form the depressed portions. The depressed portions formed on the surface of the electrophotographic photosensitive member produced by this production process are formed by the cohesive force of water, and hence they can individually have shapes of depressed portions with a high uniformity.

This production method is a production method which goes through the step of removing droplets, or removing droplets from a state that the droplets have sufficiently grown. Hence, the depressed portions of the surface of the electrophotographic photosensitive member are depressed portions formed in the shape of droplets or in the shape of honeycombs (hexagonal shape), for example. The depressed portions in the shape of droplets refer to depressed portions looking, e.g., circular or elliptic in observation of the photosensitive member surface and depressed portions looking, e.g., partially circular or partially elliptic in observation of the photosensitive member cross section. The depressed portions in the shape of honeycombs (hexagonal shape) are, e.g., depressed portions formed as a result of closest packing of droplets on the surface of the electrophotographic photosensitive member. Stated specifically, they refer to depressed portions looking, e.g., circular, hexagonal or hexagonal with round corners in observation of the photosensitive member surface and depressed portions looking, e.g., partially circular or square-pillared in observation of the photosensitive member cross section.

Thus, the method of processing the surface by the condensation on the surface of the electrophotographic photosensitive member when its surface layer is formed can produce the electrophotographic photosensitive member in which the surface has a plurality of depressed portions which are independent from one another and each have a surface opening having a major-axis diameter Rpc of from 0.1 μm or more to 10 μm or less and a minor-axis diameter Lpc of from 0.1 μm or more to 10 μm or less, and a deepest-part to opening distance Rdv of from 0.1 μm or more to 10 μm or less, and, where the surface of the electrophotographic photosensitive member is equally divided into 4 regions in the photosensitive member rotational direction, which are then equally divided into 25 regions in the direction falling at right angles with the photosensitive member rotational direction, to obtain 100-spot regions A in total, and, in each of the regions A, square regions B of 50 μm each per side one side of which is parallel to the photosensitive member rotational direction are provided and each of the regions B is equally divided into 500 zones by 499 straight lines parallel to the photosensitive member rotational direction, from 400 lines or more to 499 lines or less among the 499 lines pass through the depressed portions in each of the regions B.

The above depressed portions are controllable by adjusting production conditions within the range shown in the above production method. The depressed portions are controllable by selecting, e.g., the type of the solvent in the surface layer coating solution, the content of the solvent, the relative humidity in the base member holding step, the retention time in the holding step, and the heating and drying temperature, which are prescribed in the present specification.

Construction of the electrophotographic photosensitive member according to the present invention is described next.

The electrophotographic photosensitive member of the present invention has, as mentioned previously, a support and an organic photosensitive layer (hereinafter also simply "photosensitive layer") provided on the support. The electrophotographic photosensitive member according to the present invention may commonly be a cylindrical organic electrophotographic photosensitive member in which the photosensitive layer is formed on a cylindrical support, which is in wide use, and may also be one having the shape of a belt or sheet.

The photosensitive layer of the electrophotographic photosensitive member may be either of a single-layer type photosensitive layer which contains a charge transporting material and a charge generating material in the same layer and a multi-layer type (function-separated type) photosensitive layer which is separated into a charge generation layer containing a charge generating material and a charge transport layer containing a charge transporting material. From the viewpoint of electrophotographic performance, the electrophotographic photosensitive member according to the present invention may preferably be one having the multi-layer type photosensitive layer. The multi-layer type photosensitive layer may also be either of a regular-layer type photosensitive layer in which the charge generation layer and the charge transport layer are superposed in this order from the support side and a reverse-layer type photosensitive layer in which the charge transport layer and the charge generation layer are superposed in this order from the support side. In the electrophotographic photosensitive member according to the present invention, where the multi-layer type photosensitive layer is employed, it may preferably be the regular-layer type photosensitive layer from the viewpoint of electrophotographic performance. The charge generation layer may be formed in multi-layer structure, and the charge transport layer may also be formed in multi-layer structure. A protective layer may further be provided on the photosensitive layer for the purpose of, e.g., improving running performance.

As the support of the electrophotographic photosensitive member, it may preferably be one having conductivity (a conductive support). For example, usable are supports made of a metal such as aluminum, aluminum alloy or stainless steel. In the case of aluminum or aluminum alloy, usable are an ED pipe, an EI pipe and those obtained by subjecting these pipes to cutting, electrolytic composite polishing (electrolysis carried out using i) an electrode having electrolytic action and ii) an electrolytic solution, and polishing carried out using a grinding stone having polishing action) or to wet-process or dry-process honing. Still also usable are the above supports made of a metal, or supports made of a resin (such as polyethylene terephthalate, polybutylene terephthalate, phenol resin, polypropylene or polystyrene resin), and having layers film-formed by vacuum deposition of aluminum, an aluminum alloy or an indium oxide-tin oxide alloy. Still also usable are supports formed of resin or paper impregnated with conductive particles such as carbon black, tin oxide particles, titanium oxide particles or silver particles, and supports made of a plastic containing a conductive binder resin.

For the purpose of prevention of interference fringes caused by scattering of laser light, the surface of the support may be subjected to cutting, surface roughening or aluminum anodizing.

Where the surface of the support is a layer provided in order to impart conductivity, such a layer may have a volume resistivity of from $1\times10^{10}$ Ω·cm or less, and, in particular, more preferably $1\times10^{6}$ Ω·cm or less.

A conductive layer intended for the prevention of interference fringes caused by scattering of laser light or for the covering of scratches of the support surface may be provided between the support and an intermediate layer described later or the photosensitive layer (charge generation layer or charge transport layer). This is a layer formed by coating the support with a coating fluid prepared by dispersing a conductive powder in a suitable binder resin. Such a conductive powder may include the following: Carbon black, acetylene black; metallic powders of, e.g., aluminum, nickel, iron, nichrome, copper, zinc and silver; and metal oxide powders such as conductive tin oxide and ITO.

The binder resin used simultaneously may include the following thermoplastic resins, thermosetting resins or photocurable resins: Polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyarylate resins, phenoxy resins, polycarbonate, cellulose acetate resins, ethyl cellulose resins, polyvinyl butyral, polyvinyl formal, polyvinyltoluene, poly-N-vinyl carbazol, acrylic resins, silicone resins, epoxy resins, melamine resins, urethane resins, phenol resins and alkyd resins.

The conductive layer may be formed by coating a coating fluid prepared by dispersing or dissolving the above conductive powder and binder resin in an ether type solvent such as tetrahydrofuran or ethylene glycol dimethyl ether, an alcohol type solvent such as methanol, a ketone type solvent such as methyl ethyl ketone, or an aromatic hydrocarbon solvent such as toluene. The conductive layer may preferably have an average layer thickness of from 0.2 μm or more to 40 μm or less, more preferably from 1 μm or more to 35 μm or less, and still more preferably from 5 μm or more to 30 μm or less.

The conductive layer with a conductive pigment or resistance control pigment dispersed therein shows a tendency that its surface comes roughened.

An intermediate layer having the function as a barrier and the function of adhesion may also be provided between the support or the conductive layer and the photosensitive layer (the charge generation layer or the charge transport layer). The intermediate layer is formed for the purposes of, e.g., improving the adherence of the photosensitive layer, improving coating performance, improving the injection of electric charges from the support and protecting the photosensitive layer from any electrical breakdown.

The intermediate layer may be formed by coating a curable resin and thereafter curing the resin to form a resin layer; or by coating on the conductive layer an intermediate layer coating fluid containing a binder resin, and drying the wet coating formed.

The binder resin for the intermediate layer may include the following: Water-soluble resins such as polyvinyl alcohol, polyvinyl methyl ether, polyacrylic acids, methyl cellulose, ethyl cellulose, polyglutamic acid, and casein; and polyamide resins, polyimide resins, polyamide-imide resins, polyamic acid resins, melamine resins, epoxy resins, polyurethane resins, and polyglutamate resins. In order to bring out the electrical barrier properties effectively, and also from the viewpoint of coating properties, adherence, solvent resistance and electrical resistance, the binder resin for the intermediate layer may preferably be a thermoplastic resin. Stated specifically, a thermoplastic polyamide resin is preferred. As the polyamide resin, a low-crystalline or non-crystalline copolymer nylon is preferred as being able to be coated in the state of a solution. The intermediate layer may preferably have an average layer thickness of from 0.05 μm or more to 7 μm or less, and more preferably from 0.1 μm or more to 2 μm or less.

In the intermediate layer, semiconductive particles may be dispersed or an electron transport material (an electron accepting material such as an acceptor) may be incorporated, in order to make the flow of electric charges (carriers) not stagnate in the intermediate layer.

The photosensitive layer in the present invention is described next.

The charge generating material used in the electrophotographic photosensitive member of the present invention may include the following: Azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, and styryl dyes. Any of these charge generating materials may be used alone or may be used in combination of two or more types. Of these, particularly preferred are metal phthalocyanines such as oxytitanium phthalocyanine, hydroxygallium phthalocyanine and chlorogallium phthalocyanine, as having a high sensitivity.

In the case when the photosensitive layer is the multi-layer type photosensitive layer, the binder resin used to form the charge generation layer may include the following: Polycarbonate resins, polyester resins, polyarylate resins, butyral resins, polystyrene resins, polyvinyl acetal resins, diallyl phthalate resins, acrylic resins, methacrylic resins, vinyl acetate resins, phenol resins, silicone resins, polysulfone resins, styrene-butadiene copolymer resins, alkyd resins, epoxy resins, urea resins, and vinyl chloride-vinyl acetate copolymer resins. In particular, butyral resins are preferred. Any of these may be used alone or in the form of a mixture or copolymer of two or more types.

The charge generation layer may be formed by coating a charge generation layer coating fluid obtained by subjecting the charge generating material to dispersion together with the binder resin and a solvent, and drying the wet coating formed. The charge generation layer may also be a vacuum-deposited film of the charge generating material. As a method for dispersion, a method is available which makes use of a homogenizer, ultrasonic waves, a ball mill, a sand mill, an attritor or a roll mill. The charge generating material and the binder resin may preferably be in a proportion ranging from 10:1 to 1:10 (mass ratio), and, in particular, more preferably from 3:1 to 1:1 (mass ratio).

The solvent used for the charge generation layer coating fluid may be selected taking account of the binder resin to be used and the solubility or dispersion stability of the charge generating material.

As an organic solvent, it may include alcohol type solvents, sulfoxide type solvents, ketone type solvents, ether type solvents, ester type solvents and aromatic hydrocarbon solvents.

The charge generation layer may preferably be in an average layer thickness of 5 μm or less, and, in particular, more preferably from 0.1 μm or more to 2 μm or less.

A sensitizer, an antioxidant, an ultraviolet absorber and/or a plasticizer which may be of various types may also optionally be added to the charge generation layer. An electron transport material (an electron accepting material such as an acceptor) may also be incorporated in the charge generation layer in order to make the flow of electric charges (carriers) not stagnate in the charge generation layer.

The charge transporting material used in the electrophotographic photosensitive member of the present invention may include, e.g., triarylamine compounds, hydrazone compounds, styryl compounds, stilbene compounds, pyrazoline compounds, oxazole compounds, thiazole compounds, and triarylmethane compounds. Only one of any of these charge transporting materials may be used, or two or more types may be used.

The charge transport layer may be formed by coating a charge transport layer coating solution prepared by dissolving the charge transporting material and a binder resin in a solvent, and drying the wet coating formed. Also, of the above charge transporting materials, one having film forming properties by itself may be film-formed alone without use of any binder resin to afford the charge transport layer.

In the case when the photosensitive layer is the multi-layer type photosensitive layer, the binder resin used to form the charge transport layer may include the following: Acrylic resins, styrene resins, polyester resins, polycarbonate resins, polyarylate resins, polysulfone resins, polyphenylene oxide resins, epoxy resins, polyurethane resins, alkyd resins and unsaturated resins. In particular, polymethyl methacrylate resins, polystyrene resins, styrene-acrylonitrile copolymer resins, polycarbonate resins, polyarylate resins and diallyl phthalate resins are preferred. Any of these may be used alone or in the form of a mixture or copolymer of two or more types.

The charge transport layer may be formed by coating a charge transport layer coating solution obtained by dissolving the charge transporting material and binder resin in a solvent, and drying the wet coating formed. The charge transporting material and the binder resin may preferably be in a proportion ranging from 2:1 to 1:2 (mass ratio).

The solvent used in the charge transport layer coating solution may include the following: Ketone type solvents such as acetone and methyl ethyl ketone, ester type solvents such as methyl acetate and ethyl acetate, ether type solvents such as tetrahydrofuran, dioxoran, dimethoxymethane and dimethoxymethane, aromatic hydrocarbon solvents such as toluene, xylene and chlorobenzene. Any of these solvents may be used alone, or may be used in the form of a mixture of two or more types. Of these solvents, from the viewpoint of resin dissolving properties, it is preferable to use ether type solvents or aromatic hydrocarbon solvents.

The charge transport layer may preferably be in an average layer thickness of from 5 μm or more to 50 μm or less, and, in particular, more preferably from 10 μm or more to 35 μm or less.

An antioxidant, an ultraviolet absorber and/or a plasticizer for example may also optionally be added to the charge transport layer.

To improve running performance which is one of properties required in the electrophotographic photosensitive member in the present invention, material designing of the charge transport layer serving as a surface layer is important in the case of the above function-separated type photosensitive layer. For example, available are a method in which a binder resin having a high strength is used, a method in which the proportion of a charge-transporting material showing plasticity to the binder resin is made proper, and a method in which a high-molecular charge transporting material is used. In order to more bring out the running performance, it is effective for the surface layer to be made up of a cure type resin.

As a method in which the surface layer is made up of such a cure type resin, for example the charge transport layer may be made up of the cure type resin, or, on the charge transport layer, a cure type resin layer may be formed as a second charge transport layer or a protective layer. Properties required in the cure type resin layer are both film strength and charge transporting ability, and such a layer is commonly made up of a charge transporting material and a polymerizable or cross-linkable monomer or oligomer.

As a method in which such a surface layer is made up of the cure type resin, any known hole transporting compound or electron transporting compound may be used as the charge transporting material. A material for synthesizing these compounds may include chain polymerization type materials having an acryloyloxyl group or a styrene group. It may also include successive polymerization type materials having a hydroxyl group, an alkoxysilyl group or an isocyanate group. In particular, from the viewpoints of electrophotographic performance, general-purpose properties, material designing and production stability of the electrophotographic photosensitive member the surface layer of which is made up of the cure type resin, it is preferable to use the hole transporting compound and the chain polymerization type material in combination. Further, it is particularly preferable that the electrophotographic photosensitive member is one made up to have a surface layer formed by curing a compound having both the hole transporting group and the acryloyloxyl group in the molecule.

As a curing means, any known means may be used which makes use of heat, light or radiation.

Such a cured layer may preferably be, in the case of the charge transport layer, in an average layer thickness of from 5 μm or more to 50 μm or less, and more preferably from 10 μm or more to 35 μm or less. In the case of the second charge transport layer or protective layer, it may preferably be in an average layer thickness of from 0.1 μm or more to 20 μm or less, and still more preferably from 1 μm or more to 10 μm or less.

Various additives may be added to the respective layers of the electrophotographic photosensitive member of the present invention. Such additives may include deterioration preventives such as an antioxidant and an ultraviolet absorber, and lubricants such as fluorine atom-containing resin particles.

The electrophotographic photosensitive member of the present invention has, as described above, the specific depressed portions at least on the photosensitive layer surface of the electrophotographic photosensitive member. The depressed portions in the present invention acts effectively when applied to either of a photosensitive member the surface of which has a high hardness and a photosensitive member the surface of which has a low hardness.

Figure 15:
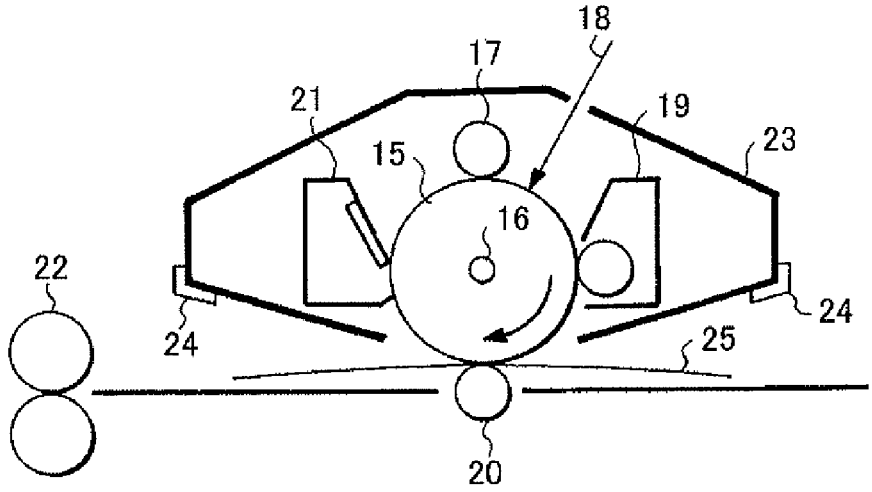
FIG. 15 is a schematic view showing an example of the construction of an electrophotographic apparatus provided with a process cartridge having the electrophotographic photosensitive member according to the present invention.

The process cartridge and electrophotographic apparatus according to the present invention are described next. FIG. 15 is a schematic view showing an example of the construction of an electrophotographic apparatus provided with a process cartridge having the electrophotographic photosensitive member of the present invention.

In FIG. 15, reference numeral 15 denotes a cylindrical electrophotographic photosensitive member, which is rotatingly driven around an axis 16 in the direction of an arrow at a stated peripheral speed.

The surface of the electrophotographic photosensitive member 15 rotatingly driven is uniformly electrostatically charged to a positive or negative, given potential through a charging device (primary charging device such as a charging roller) 17. The electrophotographic photosensitive member thus charged is then exposed to exposure light (imagewise exposure light) 18 emitted from an exposure device (not shown) for slit exposure, laser beam scanning exposure or the like. In this way, electrostatic latent images corresponding to the intended image are successively formed on the surface of the electrophotographic photosensitive member 15.

The electrostatic latent images thus formed on the surface of the electrophotographic photosensitive member 15 are developed with a toner contained in a developer a developing device 19 has, to come into toner images. Then, the toner images thus formed and held on the surface of the electrophotographic photosensitive member 15 are successively transferred by applying a transfer bias from a transfer device (e.g., a transfer roller) 20, which are successively transferred on to a transfer material (e.g., paper) 25 fed from a transfer material feed device (not shown) to the part (contact zone) between the electrophotographic photosensitive member 15 and the transfer device 20 in the manner synchronized with the rotation of the electrophotographic photosensitive member 15.

The transfer material 25 to which the toner images have been transferred is separated from the surface of the electrophotographic photosensitive member 15 and led into a fixing device 22, where the toner images are fixed, and is then put out of the apparatus as an image-formed material (a print or a copy).

The surface of the electrophotographic photosensitive member 15 from which the toner images have been transferred is brought to removal of the developer (toner) remaining after the transfer, through a cleaning device (e.g., a cleaning blade) 21. Thus, its surface is cleaned. The surface of the electrophotographic photosensitive member 15 is further subjected to charge elimination by pre-exposure light (not shown) emitted from a pre-exposure device (not shown), and thereafter repeatedly used for the formation of images. Incidentally, where as shown in FIG. 15 the charging device 17 is the contact charging device making use of, e.g., a charging roller, the pre-exposure is not necessarily required.

The apparatus may be constituted of a combination of plural components integrally joined in a container as a process cartridge from among the constituents such as the above electrophotographic photosensitive member 15, charging device 17, developing device 19 and cleaning device 21. This process cartridge may also be so set up as to be detachably mountable to the main body of an electrophotographic apparatus such as a copying machine or a laser beam printer. In the apparatus shown in FIG. 15, the electrophotographic photosensitive member 15 and the charging device 17, developing device 19 and cleaning device 21 are integrally supported to form a cartridge to set up a process cartridge 23 that is detachably mountable to the main body of the electrophotographic apparatus through a guide device 24 such as rails provided in the main body of the electrophotographic apparatus.

EXAMPLES

The present invention is described below in greater detail by giving specific working examples. In the following Examples, "part(s)" refers to "part(s) by mass".

Example 1

—Production of Electrophotographic Photosensitive Member—

An aluminum cylinder of 30 mm in diameter and 357.5 mm in length the surface of which stood worked by cutting was used as a support (cylindrical support).

Next, a mixture composed of the following components was subjected to dispersion for about 20 hours by means of a ball mill to prepare a conductive layer coating fluid.

Powder composed of barium sulfate particles having coat layers of tin oxide 60 parts (trade name: PASTRAN PC1; available from Mitsui Mining & Smelting Co., Ltd.)

Titanium oxide 15 parts (trade name: TITANIX JR; available from Tayca Corporation)

Phenolic resin 43 parts (trade name: PLYOPHEN J-325; available from Dainippon Ink & Chemicals, Incorporated; resin solid content: 60%)

Silicone oil 0.015 part (trade name: SH28PA; available from Dow Corning Toray Silicone Co., Ltd.)

Silicone resin particles 3.6 parts (trade name: TOSPEARL 120; available from Toshiba Silicone Co., Ltd.)

1-Methoxy-2-propanol 50 parts

Methanol 50 parts

The conductive layer coating fluid thus prepared was applied on the above support by dip coating, followed by heat curing for 1 hour in an oven heated to 140° C., to form a conductive layer with an average layer thickness of 15 μm at the position of 170 mm from the support upper end.

Next, an intermediate layer coating solution prepared by dissolving the following components in a mixed solvent of 400 parts of methanol and 200 parts of n-butanol was applied on the conductive layer by dip coating, followed by heat drying for 30 minutes in an oven heated to 100° C., to form an intermediate layer with an average layer thickness of 0.45 μm at the position of 170 mm from the support upper end.

Copolymer nylon resin 10 parts (trade name: AMILAN CM8000; available from Toray Industries, Inc.)

N-methoxymethylated nylon 6 resin 30 parts (trade name: TORESIN EF-30T; available from Teikoku Chemical Industry Co., Ltd.)

Next, the following components were subjected to dispersion for 4 hours by means of a sand mill making use of glass beads of 1 mm in diameter, and then 700 parts of ethyl acetate was added to prepare a charge generation layer coating fluid.

Hydroxygallium phthalocyanine 20 parts (one having strong peaks at Bragg angles of 2θ plus-minus 0.2°, of 7.5°, 9.9°, 16.3°, 18.6°, 25.1° and 28.3° in CuKα characteristics X-ray diffraction)

Carixarene compound represented by the following structural formula (1) 0.2 part (1)

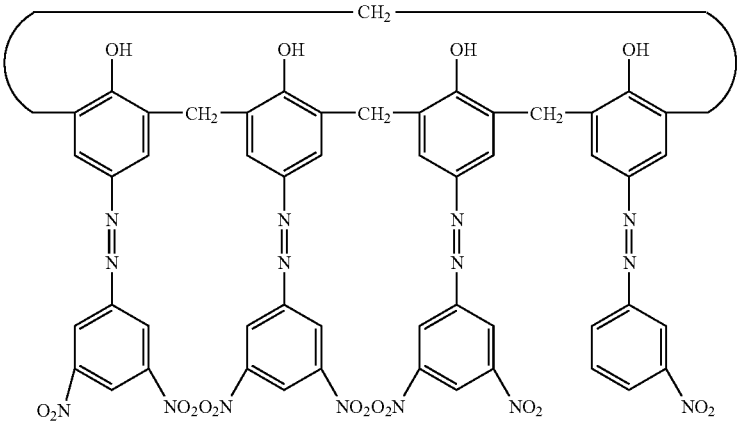

Polyvinyl butyral 10 parts (trade name: S-LEC BX-1, available from Sekisui Chemical Co., Ltd.)

Cyclohexanone 600 parts

The above charge generation layer coating fluid was applied on the intermediate layer by dip coating, followed by heat drying for 15 minutes in an oven heated to 80° C., to form a charge generation layer with an average layer thickness of 0.17 μm at the position of 170 mm from the support upper end.

Next, the following components were dissolved in a mixed solvent of 600 parts of chlorobenzene and 200 parts of methylal to prepare a charge transport layer coating solution. This charge transport layer coating solution was applied on the charge generation layer by dip coating, followed by heat drying for 30 minutes in an oven heated to 100° C., to form a charge transport layer with an average layer thickness of 15 μm at the position of 170 mm from the support upper end.

Charge transporting material (hole transporting material) represented by the following structural formula (2) 70 parts (2)

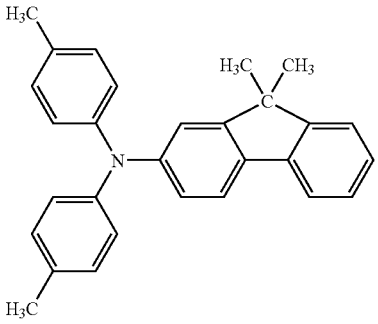

Polycarbonate resin constituted of a repeating unit represented by the following structural formula (3) 100 parts (IUPILON Z; available from Mitsubishi Engineering-Plastics Corporation; viscosity average molecular weight (Mv): 40,000)

(3)

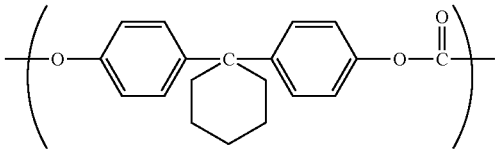

Next, 0.5 part of fluorine atom-containing resin (trade name: GF-300, available from Toagosei Chemical Industry Co., Ltd.) was dissolved in a mixed solvent of 20 parts of 1,1,2,2,3,3,4-heptafluorocyclopentane (trade name: ZEOROLA H, available from Nippon Zeon Co., Ltd.) and 20 parts of 1-propanol.

To the solution in which the above fluorine atom-containing resin was dissolved, 10 parts of tetrafluoroethylene resin powder (trade name: LUBRON L-2, available from Daikin Industries, Ltd.) was added. Thereafter, the solution to which the tetrafluoroethylene resin powder was added was treated four times under a pressure of 600 kgf/cm$^2$ by means of a high-pressure dispersion machine (trade name: MICROFLUIDIZER M-110EH, manufactured by Microfluidics Inc., USA) to effect uniform dispersion. Further, the solution having been subjected to the above dispersion treatment was filtered with Polyfron filter (trade name: PF-040, available from Advantec Toyo Kaisha, Ltd.) to prepare a dispersion. Thereafter, 90 parts of a charge transporting material (hole transporting material) represented by the following structural formula (4):

(4)

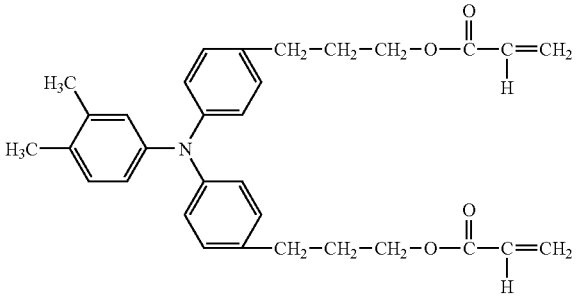

70 parts of 1,1,2,2,3,3,4-heptafluorocyclopentane and 70 parts of 1-propanol were added to the above dispersion. This was filtered with Polyfron filter (trade name: PF-020, available from Advantec Toyo Kaisha, Ltd.) to prepare a second charge transport layer coating fluid.

The second charge transport layer coating fluid was applied on the firstly formed charge transport layer by coating, followed by drying for 10 minutes in the atmosphere in an oven kept at 50° C. Thereafter, the layer formed was irradiated with electron rays for 1.6 seconds in an atmosphere of nitrogen and under conditions of an accelerating voltage of 150 kV and a beam current of 3.0 mA while rotating this support at 200 rpm. Subsequently, in an atmosphere of nitrogen, the temperature around the support was raised from 25° C. to 125° C. over a period of 30 seconds to carry out curing reaction of the substance contained in the second charge transport layer formed. Here, the absorbed dose of electron rays was measured to find that it was 15 KGy. Oxygen concentration in the atmosphere of electron ray irradiation and heat curing reaction was found to be 15 ppm or less. Thereafter, the support thus treated was naturally cooled to 25° C. in the atmosphere, and then subjected to heat treatment for 30 minutes in the atmosphere in an oven heated to 100° C., to form a protective layer with an average layer thickness of 5 μm at the position of 170 mm from the support upper end. Thus, an electrophotographic photosensitive member was obtained.

—Formation of Depressed Portions by Excimer Laser—

Figure 16:
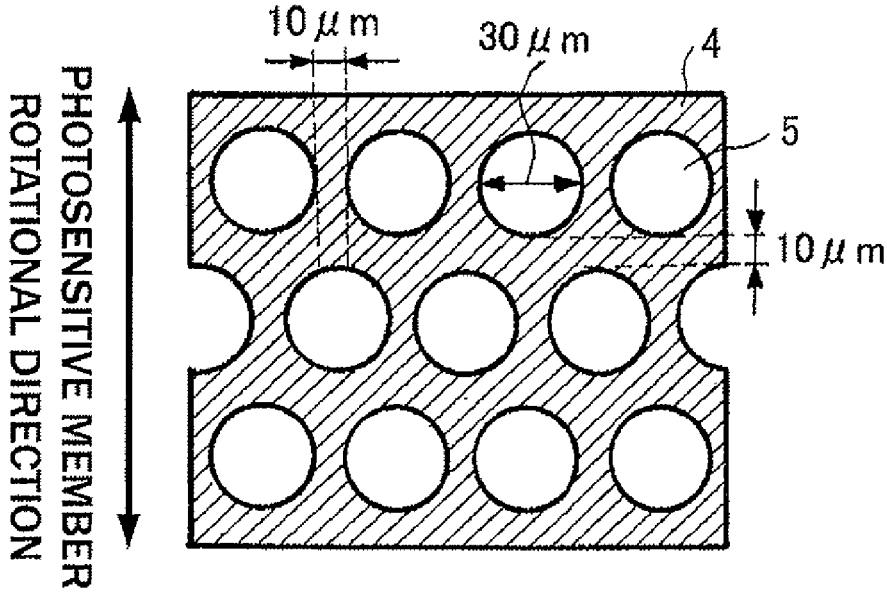
FIG. 16 is a partial enlarged view showing an example of an arrangement pattern of a laser mask used in Example 1.

On the outermost surface layer of the electrophotographic photosensitive member obtained, depressed portions were formed by using a KrF excimer laser (wavelength λ: 248 nm). Here, a mask made of quartz glass was used which had a pattern in which, as shown in FIG. 16, circular laser light transmitting areas 5 of 30 μm in diameter were arranged at intervals of 10 μm. In FIG. 16, reference numeral 4 denotes a laser light shielding area. Irradiation energy for the excimer laser was set at 0.9 J/cm$^3$. Irradiation was made in an area of 2 mm square per irradiation made once. As shown in FIG. 9, the processing object was rotated, during which the laser irradiation position was shifted in the axial direction to make irradiation.

—Observation of Depressed Portions Formed—

Figure 17:
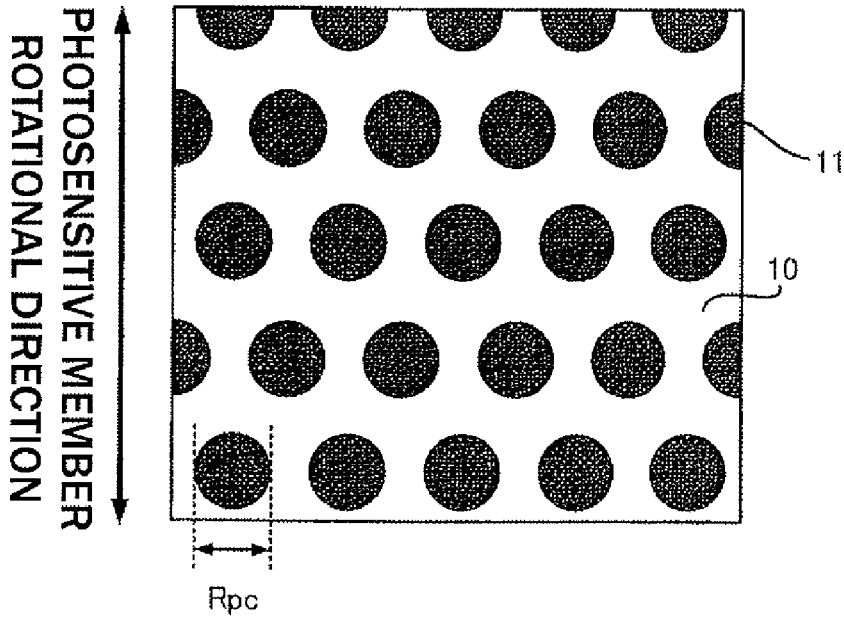
FIG. 17 is a partial enlarged view showing an arrangement pattern of depressed portions of the photosensitive member outermost surface in Example 1.

The surface profile of the electrophotographic photosensitive member obtained was observed under magnification on a laser microscope (VK-9500, manufactured by Keyence Corporation) to ascertain that depressed portions having a major-axis diameter Rpc of 8.6 μm, a minor-axis diameter Lpc of 8.6 μm and a deepest-part to opening distance Rdv of 0.9 μm stood formed in the arrangement shown in FIG. 17. In FIG. 17, reference numeral 10 denotes no-depressed-portion-formed-areas; and 11, depressed portion-formed areas.

The surface of the electrophotographic photosensitive member was equally divided into 4 regions in the photosensitive member rotational direction, which were then equally divided into 25 regions in the direction falling at right angles with the photosensitive member rotational direction, to obtain 100-spot regions A in total, and, in each of the 100-spot regions A, square regions B of 50 μm each per side one side of which was parallel to the photosensitive member rotational direction were provided. Where each of the regions B was equally divided into 500 zones by 499 straight lines parallel to the photosensitive member rotational direction, all the 499 straight lines passed through the depressed portions in all the regions B in the 100-spot regions in total.

The results of these are shown in Table 1.

—Performance Evaluation of Electrophotographic Photosensitive Member—

The electrophotographic photosensitive member produced in the manner described above was fitted to an electrophotographic copying machine GP40 (AC-DC charging system), manufactured by CANON INC., to make evaluation in the following way.

In an environment of atmospheric temperature 15° C. and relative humidity 10%, conditions of potential were so set that the dark-area potential (Vd) and light-area potential (Vl) of the electrophotographic photosensitive member came to be −700 V and −150 V, respectively, and the initial potential of the electrophotographic photosensitive member was adjusted.

Under the above conditions, a 5,000-sheet paper feed running test was conducted using A4-size paper and in a two-sheet intermittent mode. After the running test, the surface of the photosensitive member was observed under magnification on a laser microscope (VK-9500, manufactured by Keyence Corporation). The results were ranked in the following way.

A: One or less scratch of 50 μm or more in length was seen per 100 μm$^2$.

B: From 2 or more to 10 or less scratches of 50 μm or more in length were seen per 100 μm$^2$.

C: From 11 or more to 50 or less scratches of 50 μm or more in length were seen per 100 μm$^2$.

D: 51 or more scratches of 50 μm or more in length were seen per 100 μm$^2$.

On a photosensitive member produced under the same conditions as the above photosensitive member, a 50,000-sheet paper feed running test was conducted likewise using A4-size paper and in a two-sheet intermittent mode. Here, a chart having a print percentage of 5% was used as a test chart.

After the 50,000-sheet paper feed running test, halftone images were reproduced as test images to make image evaluation in the following way.

A: On the images, any streaky faulty images were not seen in the direction corresponding to the photosensitive member rotational direction.

B: On the images, streaky faulty images were slightly seen in the direction corresponding to the photosensitive member rotational direction.

C: On the images, a large number of streaky faulty images were clearly seen in the direction corresponding to the photosensitive member rotational direction.

The results of these are shown in Table 1.

Example 2

—Production of Electrophotographic Photosensitive Member—

An electrophotographic photosensitive member was produced in the same manner as that in Example 1.

—Formation of Depressed Portions by Excimer Laser—

Depressed portions were formed in the same manner as those in Example 1 except that the mask made of quartz glass was changed for one in which the circular laser light transmitting areas were 9 μm in diameter and at intervals of 3 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 3

—Production of Electrophotographic Photosensitive Member—

An electrophotographic photosensitive member was produced in the same manner as that in Example 1.

—Formation of Depressed Portions by Excimer Laser—

Depressed portions were formed in the same manner as those in Example 2 except that the irradiation energy of the excimer laser was changed to 1.5 J/cm$^3$.

—Observation of Depressed Portions Formed and Performance Evaluation of Electrophotographic Photosensitive Member—

Surface profile measurement and performance evaluation were made in the same way as those in Example 1. The results are shown in Table 1.

Example 4

—Production of Electrophotographic Photosensitive Member—

An electrophotographic photosensitive member was produced in the same manner as that in Example 1.

—Formation of Depressed Portions by Excimer Laser—

Depressed portions were formed in the same manner as those in Example 1 except that the mask made of quartz glass was changed for one in which the circular laser light transmitting areas were 6 μm in diameter and at intervals of 2 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 5

—Production of Electrophotographic Photosensitive Member—

An electrophotographic photosensitive member was produced in the same manner as that in Example 1.

—Formation of Depressed Portions by Mold Contact Pressuring Profile Transfer—

Figure 14:
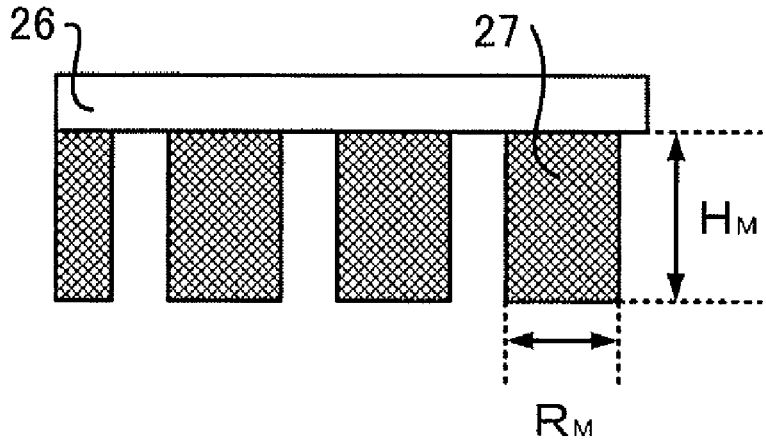
FIG. 14 is a partial enlarged view of a cross section of the photosensitive member contact surface of the mold in the present invention, showing an example of its surface profile.

In the unit shown in FIG. 12, a mold for surface profile transfer was pressured against the electrophotographic photosensitive member obtained, to effect surface profile transfer; the mold having columns with column arrangement as shown in FIGS. 13 and 14 and of 1.0 μm in diameter $R_M$ and 3.0 μm in height $H_M$. Here, the electrophotographic photosensitive member and the mold were so temperature-controlled that the charge transport layer at the pressuring part came to have a temperature of 110° C., and the photosensitive member was rotated in the rotational direction with pressuring at a pressure of 5 MPa to effect the surface profile transfer.

—Observation of Depressed Portions Formed and Performance Evaluation of Electrophotographic Photosensitive Member—

The surface profile was measured in the same way as that in Example 1 to ascertain that depressed portions stood formed in the arrangement shown in FIG. 17. In FIG. 17, reference numeral 10 denotes non-depressed portions; and 11, the depressed portions formed. Results of surface profile measurement and performance evaluation which were made in the same way as those in Example 1 are shown in Table 1.

Example 6

—Production of Electrophotographic Photosensitive Member—

An electrophotographic photosensitive member was produced in the same manner as that in Example 1.

—Formation of Depressed Portions by Mold Contact Pressuring Profile Transfer—

Surface profile transfer was effected in the same way as that in Example 5 except that the mold was changed for one in which the column height $H_M$ was 2.4 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 7

—Production of Electrophotographic Photosensitive Member—

An electrophotographic photosensitive member was produced in the same manner as that in Example 1.

—Formation of Depressed Portions by Mold Contact Pressuring Profile Transfer—

Surface profile transfer was effected in the same way as that in Example 5 except that the mold was changed for one in which the column height $H_M$ was 1.7

—Observation of Depressed Portions Formed and Performance Evaluation of Electrophotographic Photosensitive Member—

Surface profile measurement and performance evaluation were made in the same way as those in Example 1. The results are shown in Table 1.

Example 9

—Production of Electrophotographic Photosensitive Member—

An electrophotographic photosensitive member was produced in the same manner as that in Example 1.

—Formation of Depressed Portions by Mold Contact Pressuring Profile Transfer—

Surface profile transfer was effected in the same way as that in Example 5 except that the mold was changed for one in which the column height $H_M$ was 1.4 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 10

—Production of Electrophotographic Photosensitive Member—

An electrophotographic photosensitive member was produced in the same manner as that in Example 1.

—Formation of Depressed Portions by Mold Contact Pressuring Profile Transfer—

Surface profile transfer was effected in the same way as that in Example 5 except that the mold was changed for one in which the column diameter $R_M$ was 2.5 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 11

—Production of Electrophotographic Photosensitive Member—

An electrophotographic photosensitive member was produced in the same manner as that in Example 1.

—Formation of Depressed Portions by Mold Contact Pressuring Profile Transfer—

Surface profile transfer was effected in the same way as that in Example 5 except that the mold was changed for one in which the column diameter $R_M$ was 1.5 μm and the column height $H_M$ was 2.0 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 12

—Production of Electrophotographic Photosensitive Member—

An electrophotographic photosensitive member was produced in the same manner as that in Example 1.

—Formation of Depressed Portions by Mold Contact Pressuring Profile Transfer—

Figure 18:
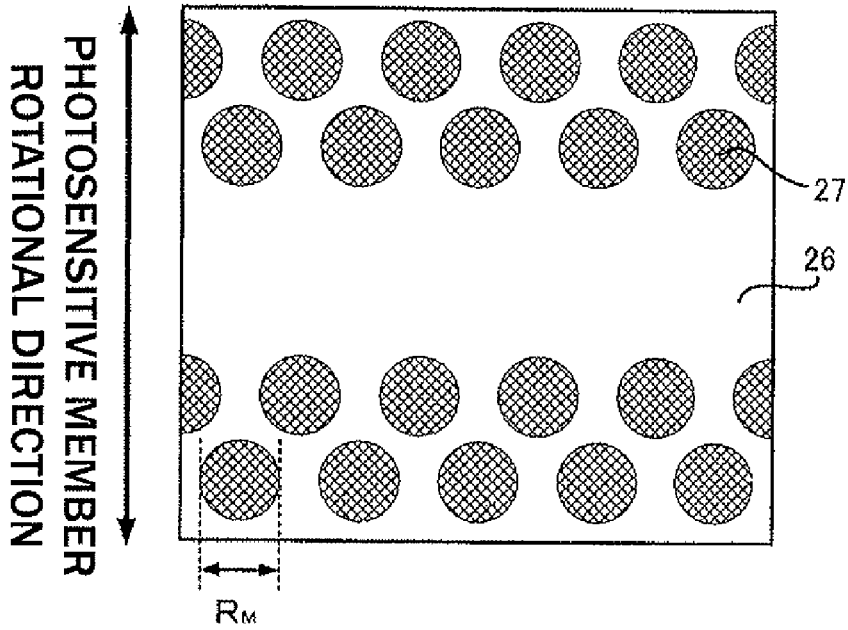
FIG. 18 is a partial enlarged view of the photosensitive member contact surface of a mold used in Example 12, showing its surface profile.

Surface profile transfer was effected in the same way as that in Example 5 except that the mold was changed for one in which the column arrangement was the arrangement shown in FIG. 18. In FIG. 18, reference numeral 26 denotes a substrate of the mold; and 27, columns of the mold.

—Observation of Depressed Portions Formed and Performance Evaluation of Electrophotographic Photosensitive Member—

Figure 19:
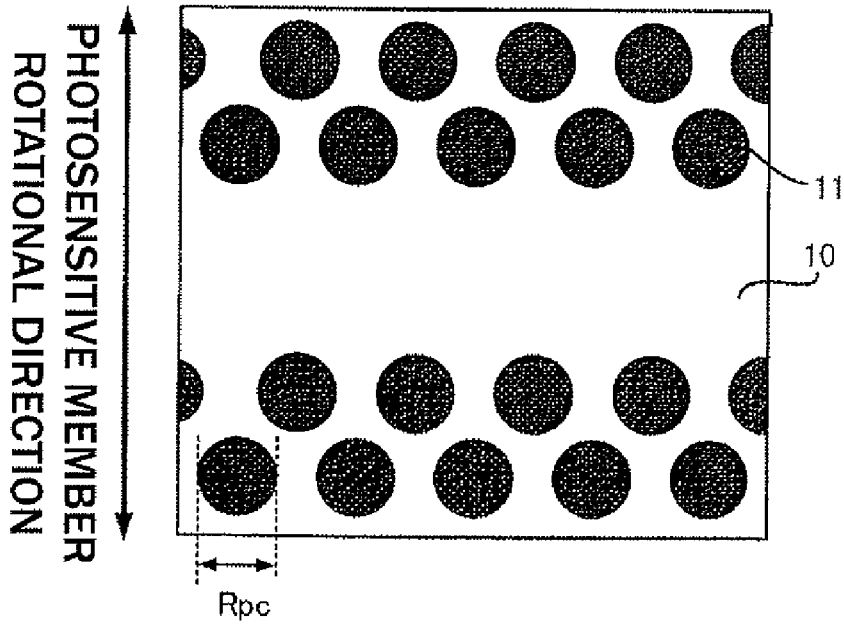
FIG. 19 is a partial enlarged view showing an arrangement pattern of depressed portions of the photosensitive member outermost surface in Example 12.

The surface profile was measured in the same way as that in Example 1 to ascertain that depressed portions stood formed in the arrangement shown in FIG. 19. In FIG. 19, reference numeral 10 denotes no-depressed portion-formed areas; and 11, depressed portion-formed areas. Results of surface profile measurement and performance evaluation which were made in the same way as those in Example 1 are shown in Table 1.

Example 13

—Production of Electrophotographic Photosensitive Member—

An electrophotographic photosensitive member was produced in the same manner as that in Example 1.

—Formation of Depressed Portions by Mold Contact Pressuring Profile Transfer—

Figure 20:
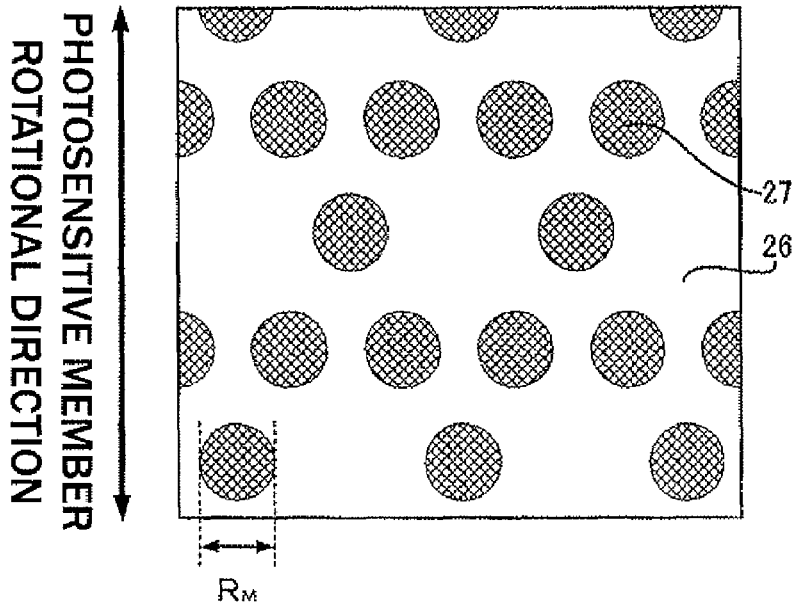
FIG. 20 is a partial enlarged view of the photosensitive member contact surface of a mold used in Example 13, showing its surface profile.

Surface profile transfer was effected in the same way as that in Example 5 except that the mold was changed for one in which the column arrangement was the arrangement shown in FIG. 20. In FIG. 20, reference numeral 26 denotes a substrate of the mold; and 27, columns of the mold.

—Observation of Depressed Portions Formed and Performance Evaluation of Electrophotographic Photosensitive Member—

Figure 21:
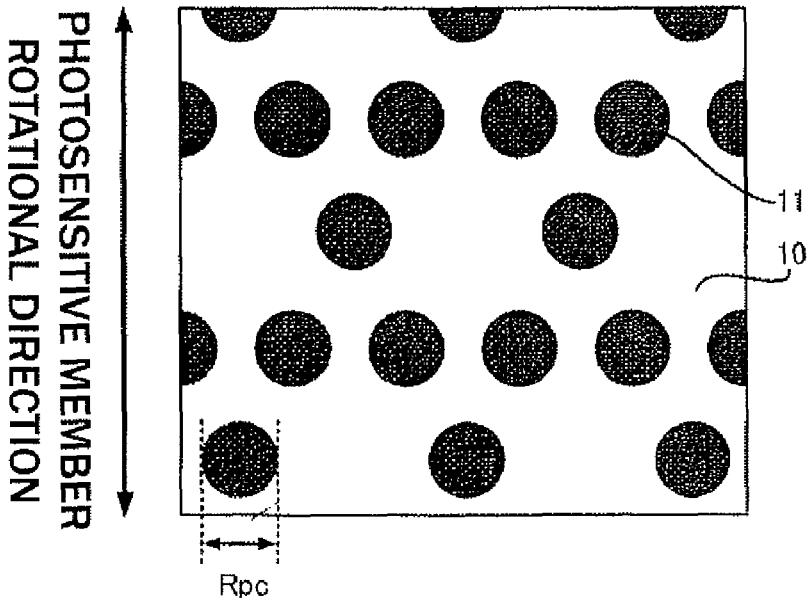
FIG. 21 is a partial enlarged view showing an arrangement pattern of depressed portions of the photosensitive member outermost surface in Example 13.

The surface profile was measured in the same way as that in Example 1 to ascertain that depressed portions stood formed in the arrangement shown in FIG. 21. In FIG. 21, reference numeral 10 denotes no-depressed portion-formed areas; and 11, depressed portion-formed areas. Results of surface profile measurement and performance evaluation which were made in the same way as those in Example 1 are shown in Table 1.

Example 14

—Production of Electrophotographic Photosensitive Member—

The procedure of Example 1 was repeated to form on the support the conductive layer, the intermediate layer and the charge generation layer.

Next, the following components were dissolved in a mixed solvent of 600 parts of chlorobenzene and 200 parts of methylal to prepare a charge transport layer coating solution. Using this charge transport layer coating solution, a wet charge transport layer was formed on the charge generation layer by dip coating, followed by heat drying for 30 minutes in an oven heated to 110° C., to form a charge transport layer with an average layer thickness of 15 μm at the position of 170 mm from the support upper end.

Charge transporting material (hole transporting material) represented by the above formula (2) 70 parts Copolymer type polyarylate resin represented by the following structural formula (5) 100 parts (5)

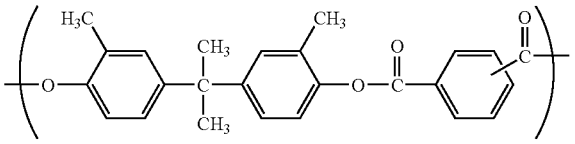

(In the formula, m and n each represent a ratio (copolymerization ratio) of repeating units in this resin. In this resin, m:n is 7:3.)

In the above polyarylate resin, the molar ratio of terephthalic acid structure to isophthalic acid structure (terephthalic acid structure:isophthalic acid structure) is 50:50. The resin has a weight average molecular weight (Mw) of 130,000.

In the present invention, the weight-average molecular weight of the resin is measured in the following way by a conventional method.

That is, a measuring target resin is put in tetrahydrofuran, and was left to stand for several hours. Thereafter, with shaking, the measuring target resin was well mixed with the tetrahydrofuran (mixed until coalescent matter of the measuring target resin disappeared), which was further left to stand for 12 hours or more.

Thereafter, what was passed through a sample-treating filter MAISHORIDISK H-25-5, available from Tosoh Corporation, was used as a sample for GPC (gel permeation chromatography).

Next, columns were stabilized in a 40EC heat chamber. To the columns kept at this temperature, tetrahydrofuran was flowed as the solvent at a flow rate of 1 ml per minute, and 10 μl of the sample for GPC was injected thereinto to measure the weight-average molecular weight of the measuring target resin. As the columns, TSKgel SuperHM-M, available from Tosoh Corporation, was used.

In measuring the weight average molecular weight of the measuring target resin, the molecular weight distribution the measuring target resin has was calculated from the relationship between the logarithmic value of a calibration curve prepared using several kinds of monodisperse polystyrene standard samples and the count number. As the standard polystyrene samples for preparing the calibration curve, used were 10 monodisperse polystyrene samples with molecular weights of 3,500, 12,000, 40,000, 75,000, 98,000, 120,000, 240,000, 500,000, 800,000 and 1,800,000 available from Aldrich Chemical Co., Inc. An RI (refractive index) detector was used as a detector.

The electrophotographic photosensitive member produced in the manner described above was subjected to surface processing in the same way as that in Example 5 except that the mold was changed for one in which the column height $H_M$ was 4.5 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 15

—Production of Electrophotographic Photosensitive Member—

An electrophotographic photosensitive member was produced in the same manner as that in Example 14.

—Formation of Depressed Portions by Mold Contact Pressuring Profile Transfer—

Surface profile transfer was effected in the same way as that in Example 5 except that the mold was changed for one in which the column height $H_M$ was 5.0 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 16

—Production of Electrophotographic Photosensitive Member—

The procedure of Example 1 was repeated to form on the support the conductive layer, the intermediate layer, the charge generation layer and the charge transport layer.

—Formation of Depressed Portions by Mold Contact Pressuring Profile Transfer—

Surface profile transfer was effected in the same way as that in Example 5 except that the mold was changed for one in which the column height $H_M$ was 2.0 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 17

—Production of Electrophotographic Photosensitive Member—

An electrophotographic photosensitive member was produced in the same manner as that in Example 16.

—Formation of Depressed Portions by Mold Contact Pressuring Profile Transfer—

Surface profile transfer was effected in the same way as that in Example 5 except that the mold was changed for one in which the column height $H_M$ was 1.0 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 18

—Production of Electrophotographic Photosensitive Member—

An electrophotographic photosensitive member was produced in the same manner as that in Example 1.

—Formation of Depressed Portions by Mold Contact Pressuring Profile Transfer—

Surface profile transfer was effected in the same way as that in Example 5 except that the mold was changed for one in which the column diameter $R_M$ was 0.5 μm and the column height $H_M$ was 2.0 μm.

—Observation of Depressed Portions Formed and Performance Evaluation of Electrophotographic Photosensitive Member—

Surface profile measurement and performance evaluation were made in the same way as those in Example 1. The results are shown in Table 1.

Example 19

—Production of Electrophotographic Photosensitive Member and Formation of Depressed Portions by Condensation—

The procedure of Example 1 was repeated to form on the support the conductive layer, the intermediate layer and the charge generation layer.

Next, 10 parts of a charge transporting material having a structure represented by the following structural formula (2):

(2)

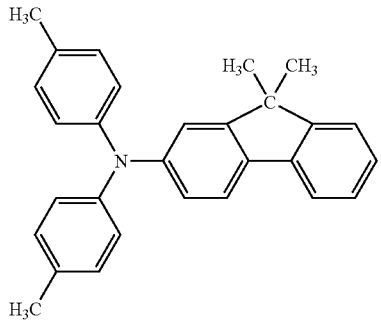

and 10 parts of a polycarbonate resin constituted of a repeating unit represented by the following structural formula (3):

(3)

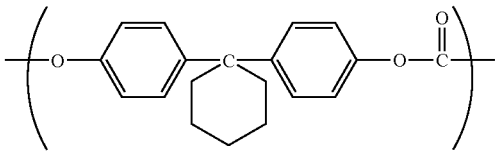

(IUPILON Z400; available from Mitsubishi Engineering-Plastics Corporation; viscosity average molecular weight (Mv): 40,000) were dissolved in a mixed solvent of 65 parts of chlorobenzene and 35 parts of dimethoxymethane to prepare a surface layer coating solution containing the charge transporting material. The step of preparing the surface layer coating solution was carried out under conditions of a relative humidity of 45% and an atmospheric temperature of 25° C.

The surface layer coating solution thus prepared was applied on the charge generation layer by dip coating to carry out the step of coating the cylindrical base member with the surface layer coating solution. The step of coating with the surface layer coating solution was carried out under conditions of a relative humidity of 45% and an atmospheric temperature of 25° C.

On lapse of 60 seconds after the coating step was completed, the cylindrical base member coated with the surface layer coating solution was retained for 120 seconds in a unit for a cylindrical base member holding step the interior of which unit was previously conditioned at a relative humidity of 70% and an atmospheric temperature of 60° C.

On lapse of 60 seconds after the cylindrical base member holding step was completed, the cylindrical base member was put into an air blow dryer the interior of which was previously heated to 120° C., to carry out a drying step for 60 minutes. Thus, an electrophotographic photosensitive member was obtained.

—Observation of Depressed Portions Formed and Performance Evaluation of Electrophotographic Photosensitive Member—

Surface profile measurement and performance evaluation were made in the same way as those in Example 1. The results are shown in Table 1.

Example 20

—Production of Electrophotographic Photosensitive Member and Formation of Depressed Portions by Condensation—

An electrophotographic photosensitive member was produced in the same manner as that in Example 19 except that, in the cylindrical base member holding step, the relative humidity was changed to 70% and the atmospheric temperature to 45° C.

—Observation of Depressed Portions Formed and Performance Evaluation of Electrophotographic Photosensitive Member—

Surface profile measurement and performance evaluation were made in the same way as those in Example 1. The results are shown in Table 1.

Example 21

—Production of Electrophotographic Photosensitive Member and Formation of Depressed Portions by Condensation—

An electrophotographic photosensitive member was produced in the same manner as that in Example 19 except that, in the cylindrical base member holding step, the relative humidity was changed to 70%, the atmospheric temperature to 30° C., and the time to hold the cylindrical base member, to 180 seconds.

—Observation of Depressed Portions Formed and Performance Evaluation of Electrophotographic Photosensitive Member—

Surface profile measurement and performance evaluation were made in the same way as those in Example 1. The results are shown in Table 1.

Example 22

—Production of Electrophotographic Photosensitive Member and Formation of Depressed Portions by Condensation—

An electrophotographic photosensitive member was produced in the same manner as that in Example 19 except that the binder resin in the surface layer coating solution was changed for a polyarylate resin (weight average molecular weight Mw: 120,000) having a repeating structural unit represented by the following structural formula (5):

(5)

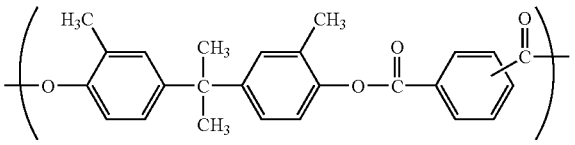

and the mixed solvent of 65 parts of chlorobenzene and 35 parts of dimethoxymethane was changed for a mixed solvent of 50 parts of chlorobenzene, 10 parts of oxoran and 40 parts of dimethoxymethane.

In the above polyarylate resin, the molar ratio of terephthalic acid structure to isophthalic acid structure (terephthalic acid structure:isophthalic acid structure) is 50:50.

—Observation of Depressed Portions Formed and Performance Evaluation of Electrophotographic Photosensitive Member—

Surface profile measurement and performance evaluation were made in the same way as those in Example 1. The results are shown in Table 1.

Example 23

—Production of Electrophotographic Photosensitive Member and Formation of Depressed Portions by Condensation—

An electrophotographic photosensitive member was produced in the same manner as that in Example 19 except that the relative humidity in the unit for the cylindrical base member holding step was changed to 70%, and the time to hold in the unit the cylindrical base member coated with the surface layer coating solution, to 80 seconds.

—Observation of Depressed Portions Formed and Performance Evaluation of Electrophotographic Photosensitive Member—

Surface profile measurement and performance evaluation were made in the same way as those in Example 1. The results are shown in Table 1.

Example 24

—Production of Electrophotographic Photosensitive Member and Formation of Depressed Portions by Condensation—

An electrophotographic photosensitive member was produced in the same manner as that in Example 23 except that, in the unit for the cylindrical base member holding step, the time to hold the cylindrical base member coated with the surface layer coating solution was changed to 60 seconds.

—Observation of Depressed Portions Formed and Performance Evaluation of Electrophotographic Photosensitive Member—

Surface profile measurement and performance evaluation were made in the same way as those in Example 1. The results are shown in Table 1.

Comparative Example 1

—Production of Electrophotographic Photosensitive Member—

An electrophotographic photosensitive member was produced in the same manner as that in Example 1.

—Formation of Depressed Portions by Mold Contact Pressuring Profile Transfer—

Figure 22:
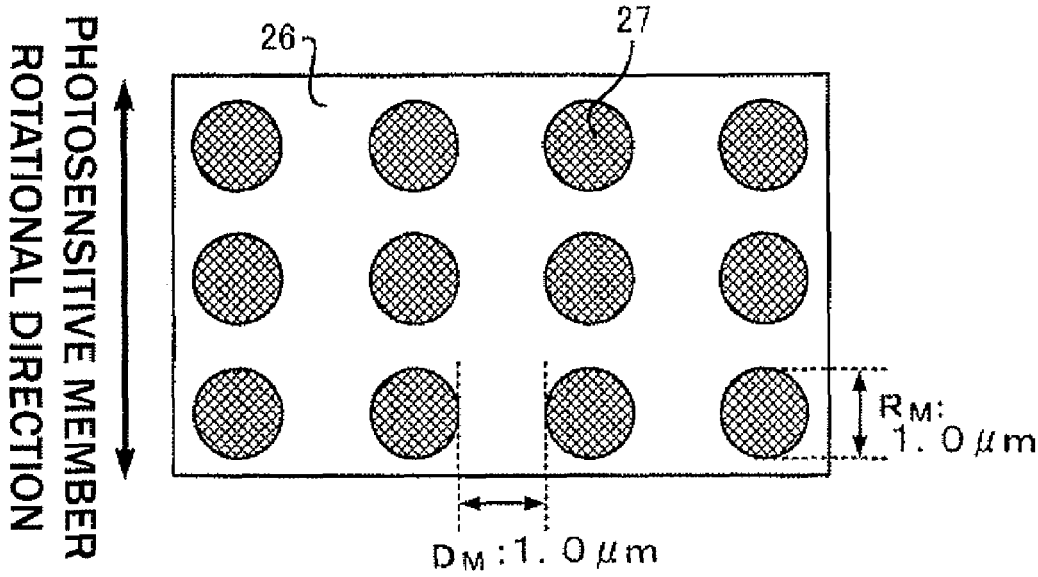
FIG. 22 is a partial enlarged view of the photosensitive member contact surface of a mold used in Comparative Example 1, showing its surface profile.

Surface profile transfer was effected in the same way as that in Example 8 except that, in the unit shown in FIG. 12, the mold was changed for one in which the columns were arranged as shown in FIG. 22 (in the drawing, column diameter $R_M$ is 1.0 μm and column interval $D_M$ is 1.0 μm). In FIG. 22, reference numeral 26 denotes a substrate of the mold; and 27, columns of the mold.

—Observation of Depressed Portions Formed and Performance Evaluation of Electrophotographic Photosensitive Member—

Figure 23:
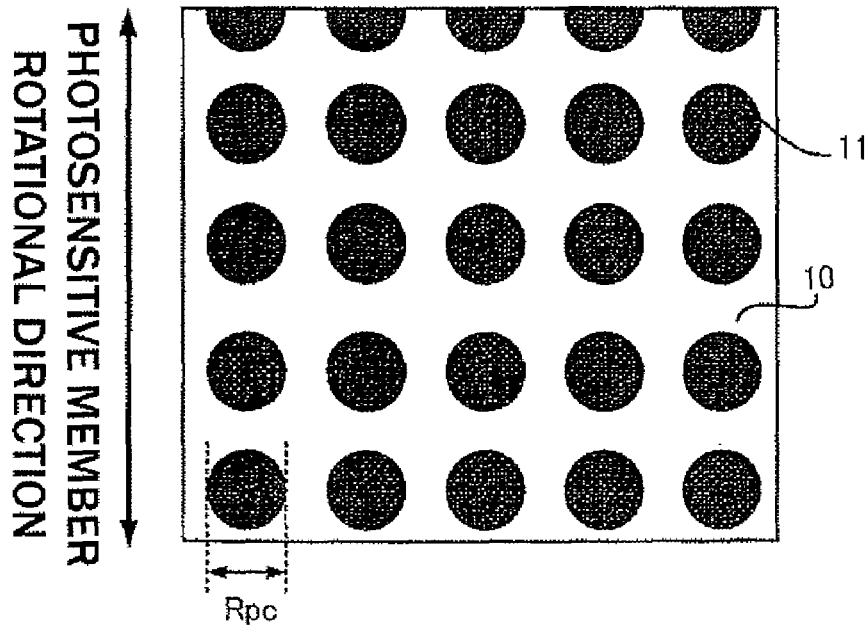
FIG. 23 is a partial enlarged view showing an arrangement pattern of depressed portions of the photosensitive member outermost surface in Comparative Example 1.

The surface profile was measured in the same way as that in Example 1 to ascertain that depressed portions stood formed in the arrangement shown in FIG. 23. In FIG. 23, reference numeral 10 denotes no-depressed portion-formed areas; and 11, depressed portion-formed areas. Results of surface profile measurement and performance evaluation which were made in the same way as those in Example 1 are shown in Table 1.

Comparative Example 2

—Production of Electrophotographic Photosensitive Member—

An electrophotographic photosensitive member was produced in the same manner as that in Example 1, and the surface of the electrophotographic photosensitive member was roughened by sand blasting in which glass beads of 35 μm in average particle diameter were blasted against the photosensitive member surface.

—Observation of Surface of Electrophotographic Photosensitive Member and Its Performance Evaluation—

Surface profile measurement and performance evaluation were made in the same way as those in Example 1. The results are shown in Table 1.

Comparative Example 3

—Production of Electrophotographic Photosensitive Member—

An electrophotographic photosensitive member was produced in the same manner as that in Example 1, but the photosensitive member surface was not processed.

—Observation of Surface of Electrophotographic Photosensitive Member and Its Performance Evaluation—

Surface profile measurement and performance evaluation were made in the same way as those in Example 1. The results are shown in Table 1.

TABLE 1

| | Major-axis diam. Rpc (μm) | Minor-axis diam. Lpc (μm) | Deepest-part to opening distance Rdv (μm) | Number of straight lines passing through depressed portions (lines) | After running test: Photosensitive member surface observation results | After running test: Image evaluation results |
|---|---|---|---|---|---|---|
| Example: | | | | | | |
| 1 | 8.6 | 8.6 | 0.9 | 499 | A | A |
| 2 | 2.6 | 2.6 | 0.9 | 499 | A | A |
| 3 | 2.6 | 2.6 | 1.5 | 499 | A | A |
| 4 | 1.7 | 1.7 | 0.9 | 499 | A | A |
| 5 | 1 | 1 | 1.5 | 499 | A | A |
| 6 | 1 | 1 | 1.2 | 499 | A | A |
| 7 | 1 | 1 | 1 | 499 | A | A |
| 9 | 1 | 1 | 0.6 | 499 | A | A |
| 10 | 2.5 | 2.5 | 1.5 | 499 | A | A |
| 11 | 1.5 | 1.5 | 1 | 499 | A | A |
| 12 | 1 | 1 | 0.8 | 499 | A | A |
| 13 | 1 | 1 | 0.8 | 499 | A | A |
| 14 | 1 | 1 | 3 | 499 | A | A |
| 15 | 1 | 1 | 3.5 | 499 | A | A |
| 16 | 1 | 1 | 1.5 | 499 | A | A |
| 17 | 1 | 1 | 0.8 | 499 | A | A |
| 18 | 0.5 | 0.5 | 1 | 499 | A | A |
| 19 | 4.2 | 4.2 | 6 | >480 | A | A |
| 20 | 1.5 | 1.5 | 2 | >480 | A | A |
| 21 | 0.4 | 0.4 | 0.6 | >480 | B | A |
| 22 | 1.3 | 1.3 | 2.8 | >480 | A | A |
| 23 | 2.5 | 2.5 | 1.8 | >480 | A | A |
| 24 | 1.8 | 1.8 | 1.5 | >480 | A | A |
| Comparative Example: | | | | | | |
| 1 | 1 | 1 | 0.8 | 350 | C | B |
| 2 | — | — | — | 0 | D | B |
| 3 | — | — | — | 0 | D | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-022896 filed on Jan. 31, 2006, No. 2006-022898 filed on Jan. 31, 2006, No. 2006-022899 filed on Jan. 31, 2006, No. 2006-022900 filed on Jan. 31, 2006 and No. 2007-016221 filed on Jan. 26, 2007, which are hereby incorporated by reference herein in their entirety.

What is claimed is:

1. An electrophotographic photosensitive member which comprises an electrically conductive support and a photosensitive layer provided thereon, wherein;

the electrophotographic photosensitive member is cylindrical or belt-shaped and has a surface having a plurality of depressed portions which are independent from one another;

the depressed portions each have i) a surface opening having a major-axis diameter Rpc of from 0.1 μm or more to 10 μm or less and a minor-axis diameter Lpc of from 0.1 μm or more to 10 μm or less and ii) a distance Rdv between the deepest part of each depressed portion and the opening thereof, of from 0.1 μm or more to 10 μm or less; and where the surface of the electrophotographic photosensitive member is equally divided into 4 regions in the rotational direction of the electrophotographic photosensitive member, which are then equally divided into 25 regions in the direction falling at right angles with the rotational direction of the photosensitive member, to obtain 100-spot regions A in total, and, in each of the regions A, square regions B of 50 μm each per side one side of which is parallel to the rotational direction of the photosensitive member are provided and each of the regions B is equally divided into 500 zones by 499 straight lines parallel to the rotational direction of the photosensitive member, from 400 lines or more to 499 lines or less among the 499 lines pass through the depressed portions in each of the regions B.

2. The electrophotographic photosensitive member according to claim 1, wherein the depressed portions each have a ratio of the deepest-part to opening distance Rdv to the major-axis diameter Rpc, Rdv/Rpc, in a value of from 0.1 or more or more to 10 or less.

3. The electrophotographic photosensitive member according to claim 1, wherein the deepest-part to opening distance Rdv of the depressed portions is from 0.5 μm or more to 5.0 μm or less.

4. The electrophotographic photosensitive member according to claim 1, wherein the major-axis diameter Rpc of the depressed portions is from 0.5 μm or more to 9.0 μm or less.

5. The electrophotographic photosensitive member according to claim 1, wherein the minor-axis diameter Lpc of the depressed portions is from 0.4 μm or more to 9.0 μm or less.

6. The electrophotographic photosensitive member according to claim 1, wherein from 450 lines or more to 499 lines or less among the 499 straight lines pass through the depressed portions in each of the regions B.

7. The electrophotographic photosensitive member according to claim 1, wherein the depressed portions are formed at the whole region of the surface.

8. A process cartridge comprising an electrophotographic photosensitive member and at least one device selected from the group consisting of a charging device, a developing device and a cleaning device; the process cartridge being detachably mountable to the main body of an electrophotographic apparatus, wherein;

the electrophotographic photosensitive member comprises an electrically conductive support and a photosensitive layer provided thereon;

the electrophotographic photosensitive has a shape of a cylinder or a belt;

the electrophotographic photosensitive member has a surface having a plurality of depressed portions which are independent from one another;

the depressed portions each have i) a surface opening having a major-axis diameter Rpc of from 0.1 μm or more to 10 μm or less and a minor-axis diameter Lpc of from 0.1 μm or more to 10 μm or less and ii) a distance Rdv between the deepest part of each depressed portion and the opening thereof, of from 0.1 μm or more to 10 μm or less; and where the surface of the electrophotographic photosensitive member is equally divided into 4 regions in the rotational direction of the electrophotographic photosensitive member, which are then equally divided into 25 regions in the direction falling at right angles with the rotational direction of the photosensitive member, to obtain 100-spot regions A in total, and, in each of the regions A, square regions B of 50 μm each per side one side of which is parallel to the rotational direction of the photosensitive member are provided and each of the regions B is equally divided into 500 zones by 499 straight lines parallel to the rotational direction of the photosensitive member, from 400 lines or more to 499 lines or less among the 499 lines pass through the depressed portions in each of the regions B.

9. An electrophotographic apparatus comprising an electrophotographic photosensitive member, a charging device, an exposure device, a developing device and a transfer device, wherein;

the electrophotographic photosensitive member comprises an electrically conductive support and a photosensitive layer provided thereon;

the electrophotographic photosensitive has a shape of a cylinder or a belt;

the electrophotographic photosensitive member has a surface having a plurality of depressed portions which are independent from one another;

the depressed portions each have i) a surface opening having a major-axis diameter Rpc of from 0.1 μm or more to 10 μm or less and a minor-axis diameter Lpc of from 0.1 μm or more to 10 μm or less and ii) a distance Rdv between the deepest part of each depressed portion and the opening thereof, of from 0.1 μm or more to 10 μm or less; and where the surface of the electrophotographic photosensitive member is equally divided into 4 regions in the rotational direction of the electrophotographic photosensitive member, which are then equally divided into 25 regions in the direction falling at right angles with the rotational direction of the photosensitive member, to obtain 100-spot regions A in total, and, in each of the regions A, square regions B of 50 μm each per side one side of which is parallel to the rotational direction of the photosensitive member are provided and each of the regions B is equally divided into 500 zones by 499 straight lines parallel to the rotational direction of the photosensitive member, from 400 lines or more to 499 lines or less among the 499 lines pass through the depressed portions in each of the regions B.

* * * * *